US010887706B2

(12) United States Patent
Feeley et al.

(10) Patent No.: US 10,887,706 B2
(45) Date of Patent: Jan. 5, 2021

(54) TRANSDUCER MODULES FOR AUDITORY COMMUNICATION DEVICES AND AUDITORY COMMUNICATION DEVICES

(71) Applicant: Hear-Wear Technologies LLC, Tulsa, OK (US)

(72) Inventors: James P. Feeley, Bixby, OK (US); Mike Feeley, Jenks, OK (US)

(73) Assignee: Hear-Wear Technologies LLC, Tulsa, OK (US)

( * ) Notice: Subject to any disclaimer, the term of this patent is extended or adjusted under 35 U.S.C. 154(b) by 808 days.

(21) Appl. No.: 15/197,584

(22) Filed: Jun. 29, 2016

(65) Prior Publication Data

US 2016/0381472 A1 Dec. 29, 2016

Related U.S. Application Data

(60) Provisional application No. 62/186,280, filed on Jun. 29, 2015.

(51) Int. Cl.
*H04R 25/00* (2006.01)

(52) U.S. Cl.
CPC ..... *H04R 25/604* (2013.01); *H04R 25/556* (2013.01); *H04R 2225/021* (2013.01); *H04R 2225/0213* (2019.05)

(58) Field of Classification Search
CPC ..... H04R 25/604; H04R 2225/021; H04R 2225/63
USPC ..... 381/328, 323, 324, 326, 314, 315
See application file for complete search history.

(56) References Cited

U.S. PATENT DOCUMENTS

| | | | |
|---|---|---|---|
| 2,930,856 | A | 3/1960 | Toht |
| 3,061,689 | A | 10/1962 | McCarrell |
| 3,197,576 | A | 7/1965 | Martin |
| 3,928,733 | A | 12/1975 | Hueber |
| 4,739,512 | A | 4/1988 | Hartl et al. |
| 4,965,831 | A | 10/1990 | Schmid |
| 5,046,580 | A | 9/1991 | Barton |
| 5,086,464 | A | 2/1992 | Groppe |
| 5,201,007 | A | 4/1993 | Ward et al. |
| 5,265,168 | A | 11/1993 | Schiess et al. |
| 5,487,012 | A | 1/1996 | Topholm et al. |
| 5,606,621 | A | 2/1997 | Reiter et al. |
| 5,701,348 | A | 12/1997 | Shennib et al. |
| 5,721,783 | A | 2/1998 | Anderson |

(Continued)

FOREIGN PATENT DOCUMENTS

| | | | |
|---|---|---|---|
| DE | 29801567 | U1 | 4/1998 |
| EP | 0288822 | A1 | 11/1988 |

(Continued)

OTHER PUBLICATIONS

WO2017004259—International search report (ISA/210).*

(Continued)

*Primary Examiner* — Phylesha Dabney
(74) *Attorney, Agent, or Firm* — Norton Rose Fulbright US LLP

(57) ABSTRACT

An on-ear speaker component for a hearing aid device. The on-ear speaker component includes an on-ear speaker housing, a speaker disposed in the on-ear speaker housing, and an electrical connection adapted to attach the speaker to a microphone in a housing different from the on-ear speaker housing.

38 Claims, 15 Drawing Sheets

(56) References Cited

U.S. PATENT DOCUMENTS

| | | | | |
|---|---|---|---|---|
| 5,757,935 | A | 5/1998 | Kang et al. | |
| 5,761,319 | A | 6/1998 | Dar et al. | |
| 5,864,628 | A | 1/1999 | Posen et al. | |
| 5,987,146 | A | 11/1999 | Pluvinage et al. | |
| 6,009,183 | A | 12/1999 | Taenzer et al. | |
| 6,022,311 | A | 2/2000 | Juneau et al. | |
| 6,101,259 | A | 8/2000 | Rapps | |
| 6,144,748 | A | 11/2000 | Kerns | |
| 6,167,141 | A | 12/2000 | Yoest | |
| 6,275,596 | B1 | 8/2001 | Fretz et al. | |
| 6,387,039 | B1 | 5/2002 | Moses | |
| 6,445,799 | B1 | 9/2002 | Taenzer et al. | |
| 6,490,362 | B1 | 12/2002 | Clegg et al. | |
| 6,600,825 | B1 | 7/2003 | Leysieffer | |
| 6,681,022 | B1 | 1/2004 | Puthuff et al. | |
| 6,704,423 | B2 | 3/2004 | Anderson et al. | |
| 6,724,902 | B1 | 4/2004 | Shennib et al. | |
| 6,748,094 | B1 | 6/2004 | Tziviskos et al. | |
| 6,920,414 | B2 | 7/2005 | Topholm | |
| 7,016,512 | B1 | 3/2006 | Feeley et al. | |
| 7,027,608 | B2 | 4/2006 | Fretz et al. | |
| 7,110,562 | B1 * | 9/2006 | Feeley ..... | H04R 25/60 381/322 |
| 7,139,404 | B2 | 11/2006 | Feeley et al. | |
| 9,118,995 | B1 | 8/2015 | Feeley et al. | |
| 2007/0127758 | A1 | 6/2007 | Pei et al. | |
| 2008/0075310 | A1 | 3/2008 | Arndt et al. | |
| 2011/0243357 | A1 * | 10/2011 | Probst ..... | H04R 25/00 381/328 |
| 2013/0004005 | A1 | 1/2013 | Barth et al. | |

FOREIGN PATENT DOCUMENTS

| | | | |
|---|---|---|---|
| EP | 0337195 | A2 | 10/1989 |
| EP | 1871141 | A2 | 12/2007 |
| EP | 2053876 | A1 | 4/2009 |
| JP | 62/1987-151100 | B1 | 7/1987 |
| WO | WO-9904601 | A1 | 1/1999 |
| WO | WO-9907182 | A2 | 2/1999 |
| WO | WO-2015010716 | A1 | 1/2015 |

OTHER PUBLICATIONS

International Search Report and Written Opinion issued for PCT Application No. PCT/US2016/040189, dated Sep. 16, 2016, 8 pages.

Second International Search Report and Written Opinion issued for PCT Application No. PCT/US2016/040189, dated Nov. 15, 2016, 17 pages.

Data Sheet for Danavox 767 AGC Body Aid Model, published in Jul. 1976.

Communication, extended European search report issued for European Patent Application No. 16818723.5, includes pursuant to Rule 62 EPC, the supplementary European search report and the European search opinion, dated May 5, 2019, 17 pages.

Communication Pursuant to Rule 164(1) EPC, Partial Supplementary European Search Report issued for European Patent Application No. 16818723.5, dated Feb. 1, 2019, 21 pages.

* cited by examiner

TRANSDUCER MODULES FOR AUDITORY COMMUNICATION DEVICES AND AUDITORY COMMUNICATION DEVICES

CROSS-REFERENCE TO RELATED APPLICATION

The present application claims priority to U.S. Provisional Patent Application No. 62/186,280, filed Jun. 29, 2015 and entitled "TRANSDUCER MODULE FOR COMMUNICATION DEVICE," the disclosure of which is incorporated by reference herein in its entirety.

TECHNICAL FIELD

The present disclosure relates to auditory communication devices and more specifically to auditory communication devices having transducer modules such as on-ear speaker components.

BACKGROUND

Some conventional auditory communication devices, such as some hearing aid devices, include a behind-the-ear (BTE) component that houses all of the electronic components. For example, a behind-the-ear component of a behind-the-ear hearing device will generally include processing circuitry, a microphone, a receiver (also referred to as a speaker), and a battery. The receiver is generally connected to a hollow acoustic tube that traverses a user's head and is inserted in an ear canal of the user.

Because the receiver and microphone are within the same housing, in the behind-the-ear hearing aid device, electroacoustic feedback is created. Electroacoustic feedback is undesirable because it produces a high squealing noise that is uncomfortable for the user. Further, the housing for behind-the-ear hearing aid devices is bulky and unattractive, in part, because it includes all the electronic components. These issues engendered the development of a hearing aid device configured differently. That different configuration includes locating the receiver in a component in the ear canal instead of in the behind-the-ear component. This type of hearing aid device is commonly referred to as a "receiver-in-canal" (RIC) device. RIC devices are disclosed by U.S. Pat. No. 5,606,621, entitled, "HYBRID BEHIND-THE-EAR AND COMPLETELY-IN-CANAL HEARING AID" to Reiter et. al., patented Feb. 25, 1997 and U.S. Pat. No. 7,139,404, entitled "BTE/CIC AUDITORY DEVICE AND MODULAR CONNECTOR SYSTEM THEREFOR" to Feeley et. al., patented Nov. 21, 2006; the disclosures of which are incorporated by reference herein in their entirety. The RIC device includes a behind-the-ear component having a microphone and processing circuitry that is electrically connected via a cable to the receiver disposed within a component that is placed in the user's ear canal. While the RIC hearing aid device addressed the feedback problem and allowed for the reduction of the size of the behind-the-ear component, among other advantages, improvements in the design and effectiveness of auditory communication devices are always desired.

BRIEF SUMMARY OF THE INVENTION

Notwithstanding the significant contribution the development of the RIC hearing aid devices brought to the field of auditory communication devices, there are some limitations in the capabilities of these types of devices. For example, a user's ear canal, in which the receiver of a RIC device is placed, has a relatively small orifice and this requires that the receiver component should be limited in size (i.e. it must be small enough to fit in the ear canal of the user) and the small orifice offers little space to maneuver and fit the receiver component within the ear canal. Additionally, RIC hearing aid devices may sometimes be more difficult to fit to a user because different users may require connectors of different lengths to fit between a behind-the-ear component and an in-canal component or completely-in-canal component.

The present invention is directed to systems and methods in which an auditory communication device such as a hearing aid is configured such that elements normally disposed in the typical behind-the-ear component are instead disposed in a different component attached to the behind-the-ear component. For example, in embodiments of the invention, a speaker and a microphone are disposed in separate housings without disposing that speaker in the ear canal. Rather, in embodiments of the invention, the speaker is disposed in a housing located on the ear of the user while the microphone remains in the behind-the-ear component. Further, in embodiments of the invention, the microphone is disposed in a housing located on the ear of the user while the speaker remains in the behind-the-ear component. Further yet, in embodiments, an antenna may be disposed in a housing located on the ear of the user and the speaker, or microphone, or both may be located in the behind-the-ear component. Also, with the antenna in the on-ear component, either the speaker or the microphone may be located with the antenna in the on-ear housing.

Embodiments of the invention include an on-ear speaker component for an auditory communication device, such as a hearing aid. The on-ear speaker component may include an on-ear speaker housing, a speaker disposed in the on-ear speaker housing, and an electrical connection. The electrical connection may be adapted to attach the speaker to a microphone in a housing different from the on-ear speaker housing.

Embodiments of the invention include an auditory communication device such as a hearing aid having a behind-the-ear component that may include a microphone disposed in a behind-the-ear component housing. The behind-the-ear component may be adapted to be disposed behind the ear of a user in operation of the auditory communication device. The auditory communication device may also have an on-ear speaker component that includes a speaker disposed in an on-ear speaker component housing. The on-ear speaker component may be adapted to be disposed on the ear of the user in operation of the auditory communication device. The auditory communication device may also have an electrical connection between the microphone and the speaker when the on-ear speaker component and the behind-the-ear component are coupled together. The auditory communication device's behind-the-ear component housing and on-ear speaker housing are different housings.

Embodiments of the invention include an on-ear transducer component for an auditory (e.g., hearing aid, monitor, etc.) device. The on-ear transducer component may include a transducer housing and an antenna disposed in or that extends from the transducer housing. The transducer component may also include an electrical connection adapted to attach the antenna to processing circuitry in a housing different from the transducer housing.

Embodiments of the invention may include a kit of different types of hearing aid components or providing this kit, where combinations of the hearing aid components, when assembled, each forms at least one RIC type device and at least one acoustic type device (i.e., receiver is external from canal). The kit may include a plurality of behind-the-ear components. The plurality of behind-the-ear components each may have a microphone and processing circuitry. The plurality of behind-the-ear components may also include behind-the-ear components of different electronic functionalities. The kit may also include a plurality of on-ear speaker components, where the plurality of on-ear speaker components have one or more speakers and the plurality of on-ear speaker components are adapted to mechanically and electronically couple to any of the plurality of behind-the-ear components. The plurality of on-ear speaker components may include on-ear speaker components of different electronic and/or acoustic functionalities. The kit may also include a plurality of sound tubes, where the plurality of sound tubes are adapted to couple to any of the plurality of on-ear speaker components, the plurality of sound tubes includes sound tubes of different lengths. The kit may further include a plurality of in-canal components and/or a plurality of completely-in-canal components, where each of the plurality of in-canal components and plurality of completely-in-canal components includes a speaker. Further yet, the kit may include a plurality of electrical connectors; where each of the electrical connectors is adapted to mechanically and electrically couple any of the plurality of behind-the-ear components, to any of the in-canal components and any of the plurality of completely-in-canal components, the plurality of electrical connectors may include connectors of different lengths.

Embodiments of the invention include an on-ear speaker component for an auditory communication device that may include a speaker housing shaped to fit around the ear of a user so that when in use a first portion of the speaker housing is positioned behind the ear, a second portion on top of the ear and a third portion in front of the user's ear. The on-ear speaker component includes a speaker disposed in the speaker housing and may include an electrical connection adapted to communicatively couple the speaker to a microphone and/or signal processing circuitry in a housing different from the speaker housing.

Embodiments of the invention include a communication device having a behind-the-ear component that may include a microphone disposed in a behind-the-ear component housing. The behind-the-ear component may be adapted to be disposed behind the ear of a user in operation of the communication device. The communication device may also include a transducer module component that includes a speaker disposed in a transducer module component housing. The transducer module component may be adapted to be disposed on the ear of the user in operation of the communication device. The communication device may further include an electrical connection between the microphone and the speaker when the transducer module component and the behind-the-ear component are coupled together. In embodiments, the behind-the-ear component housing and the transducer module component housing are different housings.

Embodiments of the invention include a communication device having a behind-the-ear component that includes a processing circuitry disposed in a behind-the-ear component housing. The behind-the-ear component may be adapted to be disposed behind the ear of a user in operation of the communication device. The communication device may include a transducer module component that includes an antenna disposed in the transducer module component housing. The transducer module component may be adapted to be disposed on and/or around the ear of the user in operation of the communication device. The communication device may further include an electrical connection between the behind-the-ear component and the transducer module component when the transducer module component and the behind-the-ear component are coupled together. In embodiments, the behind-the-ear component housing and the transducer module component housing are different housings.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION

The following description sets forth example embodiments having various features for auditory communication devices and components of auditory communication devices according to embodiments of the invention. Certain features shown in the various figures may be utilized together (e.g., as illustrated), and in many cases one or more features may be left out of some embodiments. Many of the embodiments discussed below are discussed in the context of a hearing aid device. However, the use of the features described herein may also be applicable to other types of auditory communication devices such as earphones, feedback headphones, headsets, monitors, IFB devices, etc. Further, many of the embodiments describe a transducer component that is an on-ear speaker component. However, in embodiments, alternatively or additionally, the transducer component may include other transducers such as one or more microphones or one or more antennas. For example, the transducer component may be an on-ear microphone component (that includes a microphone) for a hearing aid in which the speaker, for example, may be disposed in the behind-the-ear component. Considering another example, the transducer component may be an on-ear antenna component (that includes an antenna) for a hearing aid that, for example, may have the speaker and microphone in a behind-the-ear component.

Figure 1:
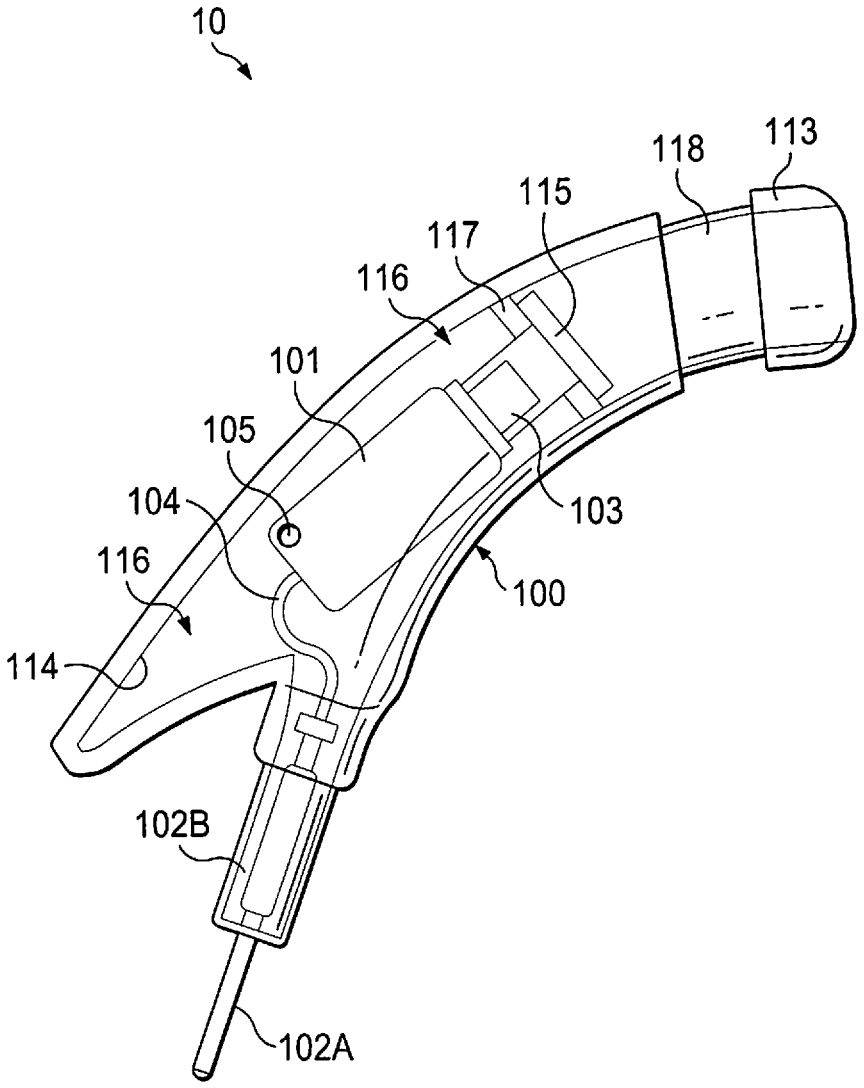
FIG. 1 shows an on-ear speaker component for an auditory communication device according to embodiments of the invention.

FIG. 1 shows an on-ear speaker component 10 for an auditory communication device such as a hearing aid, according to embodiments of the invention. As shown in FIG. 1, on-ear speaker component 10 includes on-ear speaker housing 100. In some instances, on-ear speaker housing 100 may be manufactured utilizing multiple materials selected from: plastic, rubber, elastomer, metal, composite materials (e.g., carbon fiber composites, engineered materials, etc.), the like and combinations thereof. In embodiments of the invention illustrated herein, on-ear speaker housing 100 includes transparent material. However, in embodiments of the invention, on-ear speaker housing 100 may include materials selected from: transparent materials, translucent materials, opaque materials, and combinations thereof.

FIG. 1 also shows on-ear speaker component 10 includes connector 102. Connector 102 is adapted to be connected to a different component of the auditory communication device, e.g. a behind the ear component of a hearing aid device. Connector 102 may include electrical connector (or prongs) 102A and insulation portion 102B. In embodiments of the invention, durable materials e.g. materials with high rigidity may be utilized to maintain a form factor of on-ear speaker housing 100, while softer materials, e.g. materials that are 10 to 50 durometers e.g. may be utilized around the electrical connector 102A to provide for better insulation and friction fit physical connections. Such soft materials for insulation portion 102B may include elastomer, or foam, or both.

FIG. 1 also shows that speaker 101 (e.g. speakers supplied by Knowles Electronics Incorporated) is disposed within on-ear speaker housing 100. Electrical connector 102A is electrically connected to speaker 101 by cable 104. Electrical connector 102A leads from inside to outside of on-ear speaker housing 100 so that it may be electrically connected to the other component of the auditory communication device (e.g. for connection to a behind-the-ear component of a hearing aid device and to elements of the behind-the-ear component such as a microphone and other processing circuitry or for attachment to an external audio source).

Speaker 101 also includes speaker sound port 103 to which sound tube 115 (a soft acoustic tube) is coupled. Sound tube 115 is held between walls 117 (extensions from on-ear speaker housing 100). Walls 117 also helps to create a sealed pocket area labelled as space 116. Coupling sound tube 115 to sound port 103 allows sound from speaker 101 to propagate through sound tube 115 and into acoustic channel 118. Acoustic channel 118 is formed by the on-ear speaker component housing 100. A sound tube may be attached to sound port 113 of on-ear speaker component housing 100 to channel sound from acoustic channel 118 to the ear canal of the user. For example, a cylindrically shaped sound port may be configured to fit into or fit over a cylindrically shaped sound tube that receives sound from speaker 101 and on-ear speaker component housing 100 and conducts that sound from speaker 101 and housing 100 to the ear canal of the user. Although a cylindrical shape would not be required. The sound tube that leads from on-ear speaker component 10 to the ear canal of the user may be selected from a plurality of sound tubes of different lengths to meet the requirements of the user.

As FIG. 1 shows, there is space 116 between speaker 101 and inner wall 114 of on-ear speaker component housing 100. The volume of space 116 may be varied with particular types of speakers 101 to achieve a pre-determined frequency response from the auditory communication device. In embodiments of the invention, space 116 provided in on-ear speaker housing 100 is 30 $mm^3$ to 300 $mm^3$ for a speaker of size 10 $mm^3$ to 200 $mm^3$. In other words, the internal volume of on-ear speaker component housing 100 is adapted so that it cooperates with speaker 101 to provide a pre-determined frequency response. Further, the shape of the internal volume of on-ear speaker component housing 100 may be configured to achieve a particular frequency response in cooperation with speaker 101.

Depending on the shape and volume of the internal space of on-ear speaker component housing 100, air movement caused by speaker 101 may engender additional air movement around speaker 101 and thereby create a different frequency response as compared to speaker 101 operating without this space. For example, when sound is playing in lower frequency ranges, additional air may be displaced by speaker 101 as result of space 116, which creates a particular frequency response. Thus, providing a speaker with additional airspace (e.g. space 116, a sealed inner cavity in on-ear speaker component housing 100) may improve the frequency response capabilities of speaker 101 and the auditory communication device in which it is operating. In some instances, speaker 101 may also incorporate cleared vented portions behind the rear of the speaker (on the opposite side of the output of the speaker) to further facilitate air movement. FIG. 1 shows vent 105 of on-ear speaker 101 for facilitating such air movement. Vent 105 is positioned in a manner so that the internal volume of the inner cavity to increase low frequency output of on-ear speaker component 10

Based on the above description of space 116 may be used according to embodiments of the invention, on-ear speaker 101 may be configured to emit sound of a particular frequency response characteristic. In other words, on-ear speaker 101 and space 116 around on-ear speaker 101, in on-ear speaker housing 100, may be configured to cooperate to produce a sound of a particular frequency response. In sum, because on-ear speaker housing 100 may have some physical space at the rear side of on-ear speaker 101, away from sound port 103, on-ear speaker component 10 can generate additional low range frequencies or amplify sound from the low range because of air movement within on-ear speaker housing 100.

FIG. 1 illustrates that in embodiments of the invention, speaker 101 may be suspended such that it is within inner wall 114 of on-ear speaker component housing 100 but not in contact with on-ear speaker component housing 100. Speaker 101 may be suspended by sound tube 115 in space 116 such that speaker 101 does not touch or not substantially touch inner walls 114. As shown in FIG. 1, sound tube 115 is attached to speaker port 103. As noted above, walls 117 help to create a sealed pocket area—space 116. In other words, on-ear speaker housing 100 includes an inner cavity adapted so that speaker 101 fits within the inner cavity. Sound tube 115 is attached to speaker 101 and at the same time interfaces with on-ear speaker housing 100 such that moisture, skin oils, dirt or air flow around sound port 103 is restricted. In embodiments of the invention, sound tube 115 is made of material such that vibrations from on-ear speaker housing 100 are not transmitted to speaker 101.

In embodiments, speaker 101 may not have a sound port so sound tube 115 may be attached to the body of speaker 101 so that sound flows from speaker 101 and through sound tube 115. Because speaker 101 is attached to sound tube 115, sound tube 115 keeps speaker 101 suspended in space 116 such that speaker 101 does not touch inner wall 114. Suspending speaker 101 in this way by sound tube 115 provides the following benefits: (1) shock protection—if the device is dropped it helps prevent damage to speaker 101, mechanical isolation—reduces mechanical feedback that can be caused from vibration of speaker 101 through the housing to microphones in the behind-the-ear component or in on-ear speaker component housing 100, and provides additional air space (space 116) that can provide additional output from a vented speaker (e.g. speaker 101). Additionally or alternatively, in embodiments of the invention, space 116 may be filled or partially filled with material (e.g. a gel, foam etc.) that provides mechanical isolation between speaker 101 and another element such as a microphone disposed in another component of a hearing aid, where on-ear speaker component 10 is disposed in that hearing aid.

In embodiments of the invention, on-ear speaker component 10 is disposed within on-ear speaker housing 100 in a manner such that it is oriented toward a desired sound propagation direction. For example, on-ear speaker 101 may be directed downward towards channel 118, which receives the sound from on-ear speaker 101 and propagates the sound downward into a sound tube attached to sound port 113 and, in turn, the sound tube propagates the sound into the user's ear canal.

Figure 2:
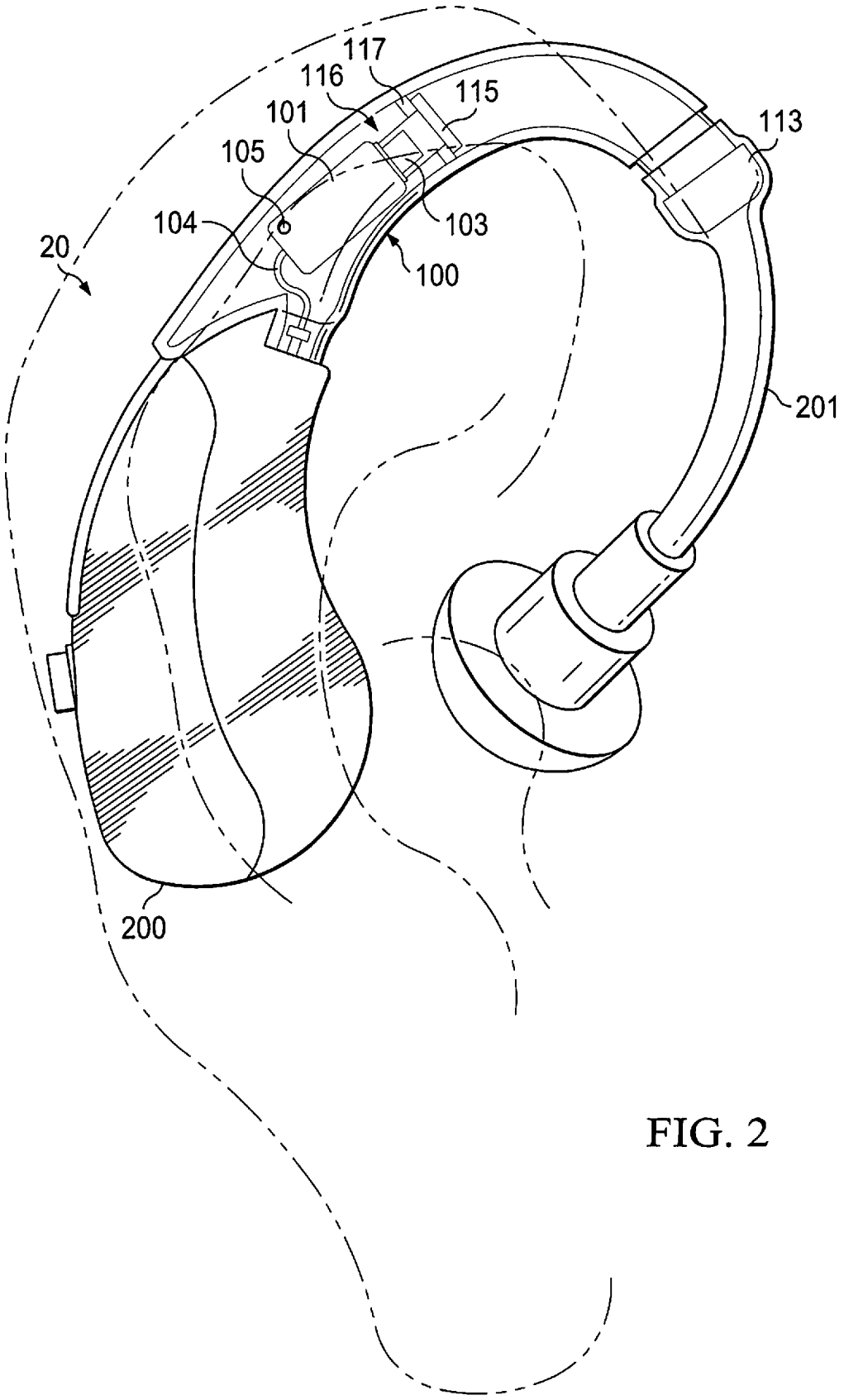
FIG. 2 shows an auditory communication device according to embodiments of the invention.

FIG. 2 shows auditory communication device 20 according to embodiments of the invention. In embodiments of the invention, on-ear speaker housing 100 may be shaped to fit in any of the positions: on the ear, behind the ear, around the ear (e.g. so a portion of on-ear speaker housing 100 fits behind the ear and part of it on the top surface of the ear and/or in front of the ear), or combinations thereof. As shown in FIG. 2, on-ear speaker component 10 is configured to be located on the ear of the user, behind the pinna, just below the highest of the point of the pinna ("A") and extending to the front of the ear of the user. In this way, on-ear speaker component 10 may be attached to one or more other components located in other positions in relation to the ear. For example, FIG. 2 shows sound tube 201 leading from sound port 113 to the ear canal of the user and, at the other end of on-ear speaker component 10 is attached behind-the ear component 200.

When on-ear speaker component 10 is positioned in the area proximate to the apex of the pinna, on-ear speaker component 10 may serve as an ear-hook for auditory communication device 20. Thus, the extent to which on-ear speaker component 10 is on or in front of the ear may be implemented for device retaining purposes (e.g. the further on-ear speaker component 10 extends around the ear, the more secure the device may be). On-ear speaker component 10 may be shaped to fit on the ear of the user to secure on-ear speaker component 10, as well as one or more other components attached to on-ear speaker component 10, to the user's ear. As shown in FIG. 2, the one or more other components may include behind-the-ear component 200 and sound tube 201.

In embodiments of the invention, on-ear speaker component 10 may be configured to affect the electroacoustic performance of auditory communication device 20 as a whole. For example, the shape, or length, or both of on-ear speaker component 10 may be configured to provide a sufficient distance between speaker 101 in on-ear speaker component 10 and other electronic elements in other components attached to on-ear speaker component 10. For example, the length of on-ear speaker component 10 and position of speaker 101 within on-ear speaker component 10 may be such that the distance between speaker 101 and a microphone and other processing circuitry (e.g. signal processing circuitry) in behind-the-ear component 200 is sufficient to prevent electroacoustic feedback (described above). In embodiments, on-ear speaker component 10 may extend further around the ear than behind-the-ear component 200. In other words, in some embodiments, on-ear speaker component 10 is longer than behind-the-ear component 200.

Figure 3A:
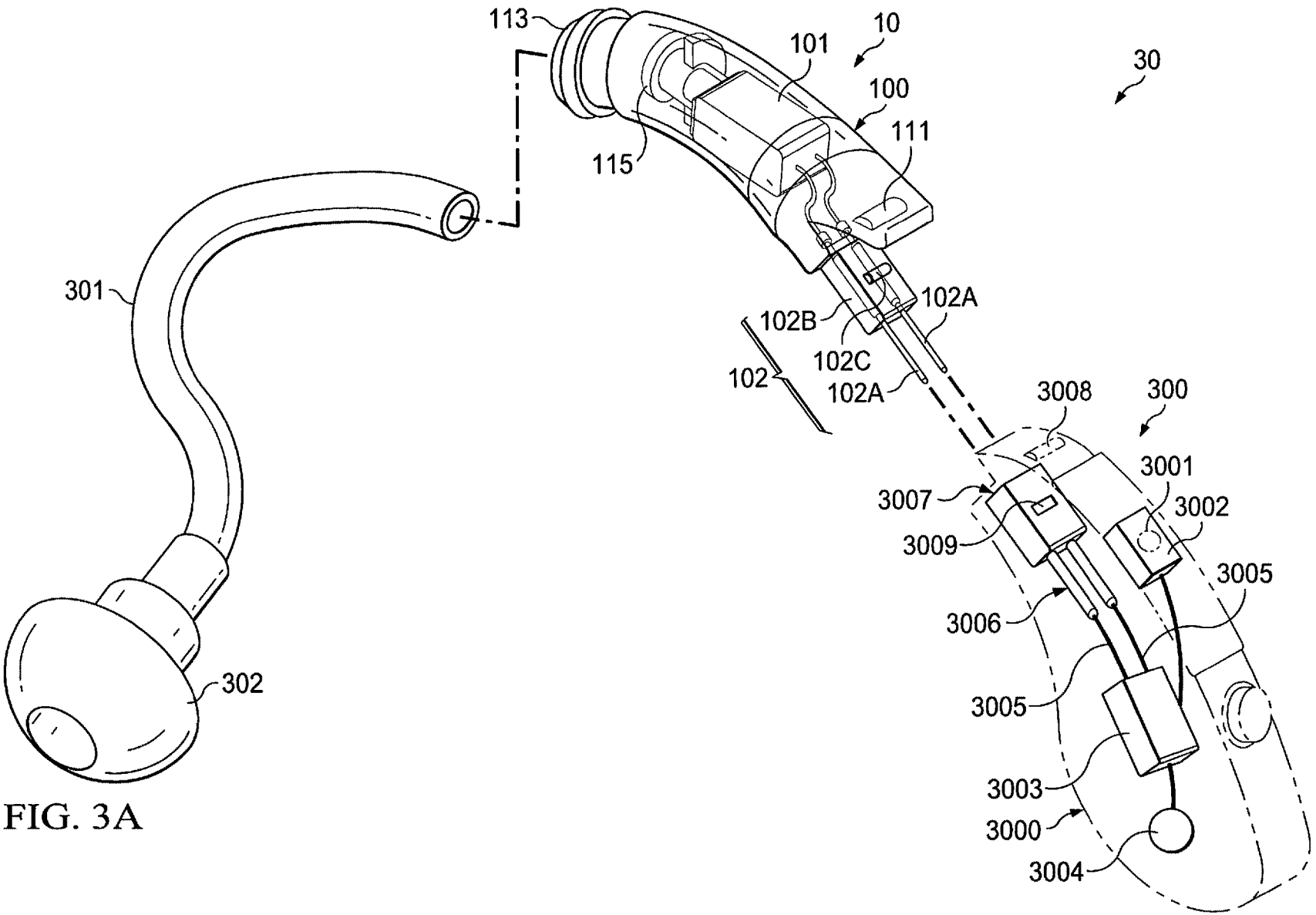
FIGS. 3A and 3B show hearing aid device, detached and assembled, respectively, according to embodiments of the invention.
Figure 3B:
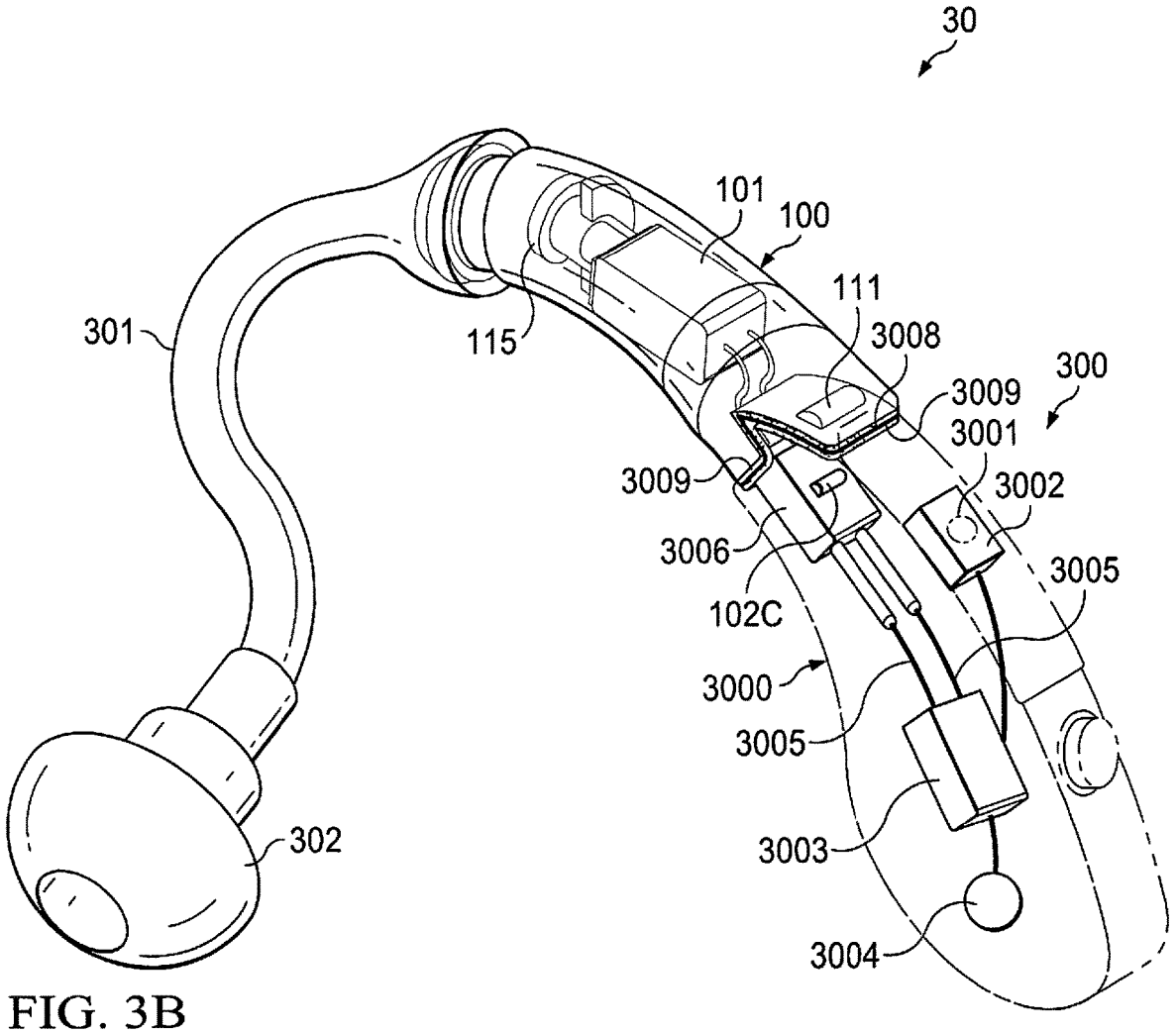

FIGS. 3A and 3B show an auditory communication device, according to embodiments of the invention. FIG. 3A shows the auditory communication device in a detached state and FIG. 3B shows the auditory communication device in an assembled state. The auditory communication device of FIGS. 3A and 3B is hearing aid device 30, which includes behind-the-ear component 300, on-ear speaker component 10 (which has a different housing from behind-the-ear component 300), and sound tube 301. The features of on-ear speaker component 10 have been described above.

Behind-the-ear component 300 is adapted to fit behind the lower section of the ear of the user. Behind-the-ear component 300 includes behind-the-ear component housing 3000, which may be made materials selected from: plastic, acrylic, rubber, elastomer, metal, composite materials (e.g., carbon fiber composites, engineered materials, etc.), the like and combinations thereof. Behind-the-ear component 300 may have elements such as microphone port 3001, one or more microphones 3002, one or more communications links 3005, processing circuitry 3003 (which may include sound processing circuitry), a power source 3004 (e.g. a battery), and combinations thereof. Processing circuitry may include one or more amplifiers (e.g. multi-channel and programmable, one or more compressors, one or more filters, packetizing circuitry, de-packetizing circuitry, modulation circuitry, conversion circuitry, the like, and combinations thereof). The processing circuitry may include analog, programmable analog, digital circuitry, and combinations thereof.

In embodiments of the invention, behind-the-ear component 300 may be a connector that connects the auditory communication device to a device remote from behind-the-ear component 300, e.g. a musician's monitor wired cable. In such embodiments, behind-the-ear component 300 operates as a wired communication link. In embodiments of the invention, behind-the-ear component 300 may be a wireless connector that connects the auditory communication device to a device remote from behind-the-ear component 300. In such embodiments, behind-the-ear component 200 operates as a wireless communication link.

As shown in FIGS. 3A and 3B, on-ear speaker component 10 and behind-the-ear component 300 are adapted to physically mate to, connect to, and have a snug fit with each other. In embodiments, behind-the-ear component housing 3000 and on-ear speaker component housing 100 are adapted to be detachably connected to each other. Latching mechanism 111/3008 may latch behind-the-ear component housing 3000 to on-ear speaker component housing 100.

In embodiments of the invention, connector 102, which, as noted above includes electrical connectors 102A and insulating portion 102B, is adapted to electrically and physically mate with a corresponding receptacle 3007 and electrical sockets 3006 of behind-the-ear component 300. Connector 102 may be single-pronged or multi-pronged. FIGS. 3A and 3B show connector 102 is a multi-pronged plug (i.e. it has at least two prongs). One prong being a positive and another being a negative power lead for speaker 101. Embodiments of the invention may utilize additional prongs. For example, embodiments of the invention may include a three wire connection, and/or prongs to connect additional audio components such as additional speakers, microphones, sensors, and the like.

Electrical connector 102A of on-ear speaker component 10 and electrical sockets 3006 of behind-the-ear component 300 provide an electrical connection between speaker 101 and the electronic elements disposed in behind-the ear component 300 (e.g. microphone 3002, processing circuitry 3003, and power source 3004). As noted above, behind-the-ear component 300 includes electrical sockets 3006 for receiving electrical connectors 102A (prongs) of on-ear speaker component 10. In embodiments of the invention, connector 102 may also include latching mechanism 102C/3009 that secures the physical connection between on-ear speaker housing 100 and behind-the-ear component 300 of behind-the-ear hearing aid device 30. Alternatively or additionally, connector 102 may be configured such that a friction fit secures the physical connection.

In embodiments of the invention, insulating portion 102B may act as an electrical insulator as well as it may be configured to seal and protect electrical connector 102A, sockets 3006, and the interface between electrical connector 102A and sockets 3006 from materials such as dirt and moisture, which may emanate from a user as a result of everyday wear of hearing aid device 30. Insulating portion 102B seals and protects by having a close fit with receptacle 3007 to keep out unwanted elements such as dirt and water.

In embodiments of the invention, insulating portion 102B may also be adapted to be an acoustical insulating seal that prevents sound leaking from speaker 101 out toward the connection interface between electrical connectors 102A and sockets 3006. In embodiments of the invention, insulating portion 102B is adapted to prevent sound leakage by being made of material such as elastomer and configured to be received in a receptacle area 3007 of behind-the-ear component 300. In this way insulating portion 102B reduces feedback from speaker 101 into microphone 3002 located in behind-the-ear component 300 or other components located in ear, in canal, or external component positioned in close proximity to the ear of the user.

Further, in embodiments of the invention, connector 102 is designed to reduce mechanical feedback, such as vibrations that may propagate from on-ear speaker housing 101 toward processing circuitry 3003, or microphone 3001 or both. This may be achieved by making insulating portion 102B of vibration insulating material (e.g. materials that include butyl rubber, silicone, elastomer, and foam) being configured to be disposed between on-ear speaker housing 100 and behind-the-ear component 300, as shown in FIG. 3B. Additionally or alternatively, vibration insulating material may be disposed between on-ear speaker housing 100 and behind-the-ear component 300 (layer 3008), in either of the housings or both housings (layers 3009), as shown in FIG. 3B.

Connector 102 could be implemented in other ways than as illustrated in the figures, such as with a single coaxial connector and/or with a magnetic coupling component. The figures illustrate that connector 102 has a male end disposed on on-ear speaker component 10, but some embodiments may include a female end in on-ear speaker component 10 that is configured to receive a corresponding male connection from behind-the-ear component 300.

An advantage of the configuration of hearing aid device 30 results from speaker 101 being in a separate housing (on-ear speaker housing 100) from behind-the-ear component 300, which includes microphone 3002 and processing circuitry 3003. As shown in FIGS. 3A and 3B, microphone 3002 is disposed on the top surface of behind-the-ear component 300 near the connection point between on-ear speaker housing 100 and behind-the-ear component 300. This location of microphone 3002 provides some distance between microphone 3002 and speaker 101, which assists in minimizing feedback. Further, because on-ear speaker component 10 and behind-the-ear component 300 are separate, additional feedback insulation and sealing of speaker 101 may be implemented between the two components, thereby further reducing electroacoustic feedback. For example, layers 3008 and 3009 discussed above may also reduce electroacoustic feedback.

In addition to behind-the-ear component 300, sound tube 301 may be attached to on-ear speaker component. Sound tube 301 has a hollow portion formed by walls that may be made of materials selected from: nylon, plastic, rubber, elastomer, metal, composite materials (e.g., carbon fiber composites, engineered materials, etc.), the like and combinations thereof. One end of sound tube 301 tightly and communicatively connects to sound port 113 to conduct sound from on-ear speaker 101 and channel 118 to an ear canal of the user. The other end of sound tube 301 may include ear piece 302 for holding sound tube 301 within the ear canal. Ear piece 302 may be a part of sound tube 301 or an attachment to sound tube 301.

On-ear speaker component housing 100 may be shaped such that it facilitates its physical connection to sound tube 301 (e.g. by providing a snap mechanism, latching mechanism or a friction fit, or combinations thereof). In some aspects, the shape of on-ear speaker component housing 100 (sound port 113) at the connection point with sound tube 301 may be such that it facilitates acoustically sealing sound that propagates from on-ear speaker 101 so that all or most of the sound is directed into sound tube 301. In embodiments of the invention, sound tube 301 may have a thickened portion, which assists in securing the physical connection (e.g. to provide the friction fit or snap fit) between sound tube 301 and on-ear speaker housing 100).

Figure 4:
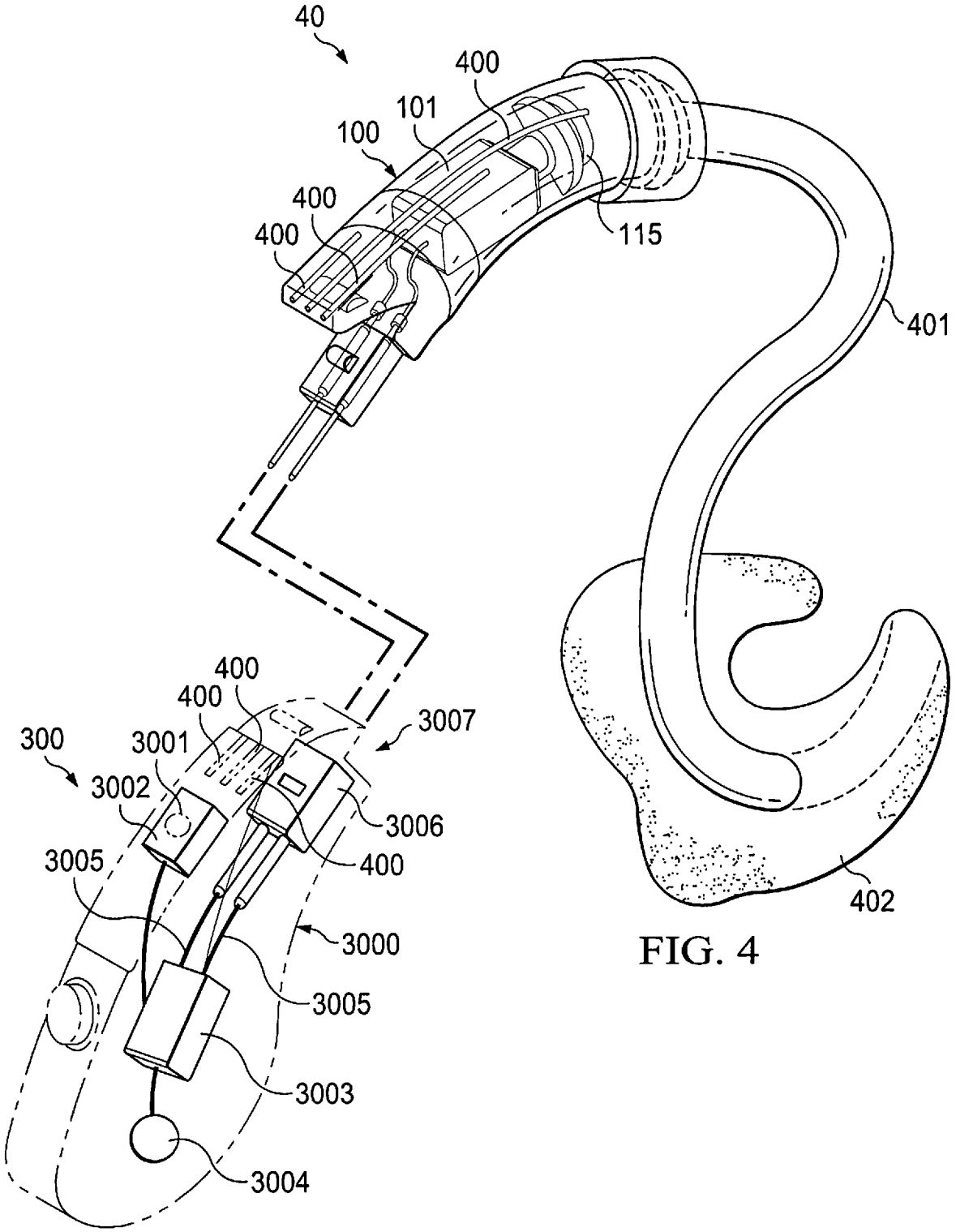
FIG. 4 shows a hearing aid according to embodiments of the invention.

FIG. 4 shows hearing aid device 40 according to embodiments of the invention. Hearing aid device 40 is configured the same way as hearing aid device 30 described above, except that hearing aid device 40 has ear piece 402 instead of ear piece 302 and on-ear speaker housing 100 has hollow portions (channels 400). Ear piece 402 shows that different types of ear pieces or molds may be used with embodiments of the invention. FIG. 4 illustrates that in embodiments of the invention, on-ear speaker housing 100 may include one or more hollow portions (channels 400) to assist in the directionality of a microphone in behind-the-ear component 300. For example, FIG. 4 shows hearing aid device 40 having microphone 3002 located at the top of behind-the-ear component 300 and proximate to on-ear speaker housing 100. As shown in FIG. 4, channels 400 is aligned with corresponding channels in behind-the-ear component 300 and microphone 3002 in a manner that provides further directionality for the microphone. Channels 400 may also provide additional advantages. Channels 400 may also guard the sound quality of microphone 3002, e.g. by cutting down on wind noise and/or protect the microphone from moisture, dirt or debris.

Figure 5:
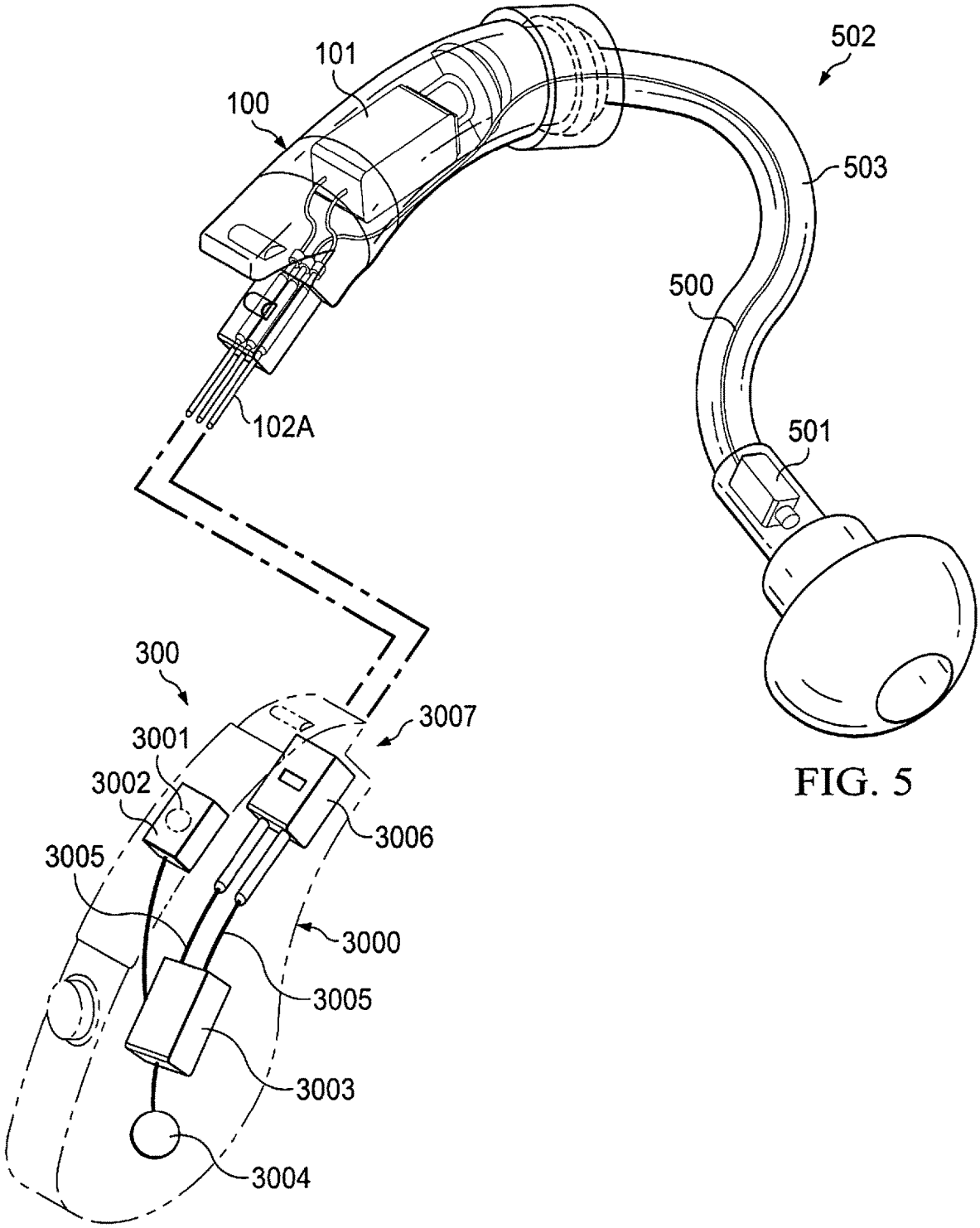
FIG. 5 shows a hearing aid according to embodiments of the invention.

Embodiments of the invention may include multiple speakers in an auditory communication device such as a hearing aid to accomplish various purposes. For example, different speakers may be utilized to provide different frequency response and output amongst the speakers. In some embodiments, a first speaker may be disposed in the on-ear speaker housing, while a second speaker is disposed remotely. FIG. 5, for example, shows a first speaker (on-ear speaker 101) disposed in on-ear speaker housing 100. A second speaker (speaker 501), located at the end of hybrid sound tube/in-canal or completely-in-canal connector 502 (which includes sound tube 503, electrical connector 500 and speaker 501) may be disposed in a user's ear canal. Speaker 501 may be electrically connected (such as by electrical connector 500), or may be wirelessly connected to external processing circuitry. This configuration may provide acoustical advantages. For example, on-ear speaker 101, being disposed in on-ear speaker housing 100 has better low-frequency range response, while speaker 501, disposed in the ear of the user has a higher frequency range response. This allows for a smaller speaker to be placed in the ear canal and compensates for the fact that sound traveling through a small diameter acoustic tube has the tendency to reduce the amplitude of higher range frequencies.

As mentioned above, electrical cable 500 connects speaker 501, disposed in a user's ear canal, to electrical connector 102A of on-ear speaker housing 100. As illustrated in FIG. 5, cable 500 is disposed within sound tube 301 or through a separate channel of sound tube 301. However, cable 500 may be run outside of and separately from sound tube 503 or may be molded into the material that forms sound tube 503. In embodiments in which electrical cable 500 is disposed within sound tube 503, the size of sound tube 503 may be adapted to take into account that electrical cable 500 will block some of the sound propagation in sound tube 503 that comes from speaker 101. In this way, the embodiment is adapted so that it is acceptable to have electrical cable 500 disposed within sound tube 503. In embodiments of the invention, electrical cable 500 may be disposed within sound tube 503 so that electrical cable 500 and sound tube 503 are separate structures. In such embodiments, a clip or band may be used to hold electrical cable 500 and sound tube 503 together.

Auditory communication devices according to embodiments of the invention may include a plurality of different types of speakers placed in different positions within the device for purposes other than achieving adequate high, mid, and low frequency response, as described above. For example, a first speaker may be utilized to provide sound from different sources such as microphone inputs, wireless transmissions, other inputs from a processor such as noise cancellation frequencies, etc. Further, the ability to use a smaller speaker in the ear canal of a user may facilitate or improve the overall comfort level of a device being worn by a user.

Figure 6:
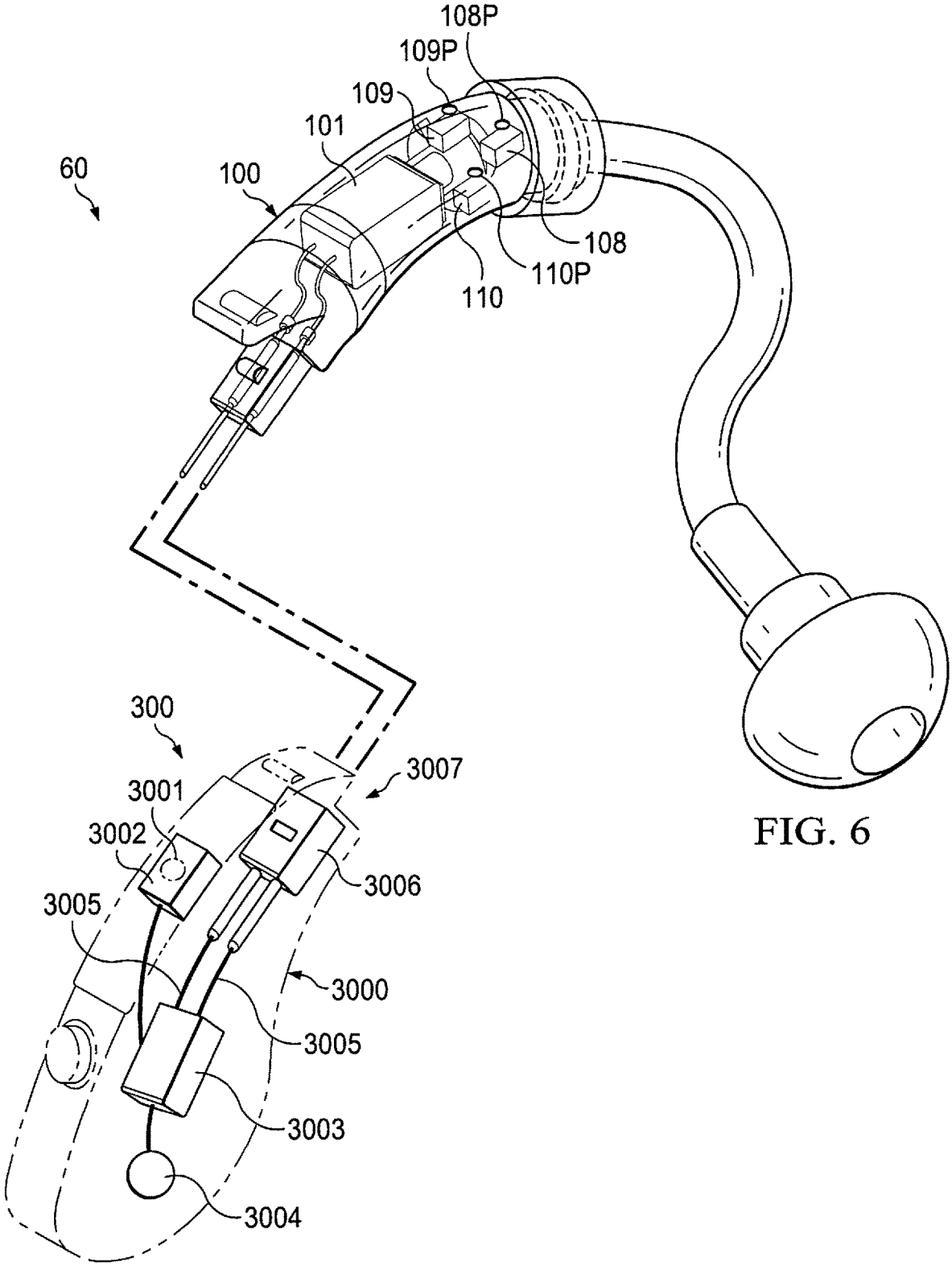
FIG. 6 shows a hearing aid according to embodiments of the invention.

In embodiments of the invention, to improve sound directionality of a hearing aid device, the on-ear transducer component, may include one or more microphones 108-110, as shown in FIG. 6. For example, in embodiments of the invention, microphone 3002 may be an omni-directional microphone that is disposed in behind-the-ear component 300, as is typical of conventional behind-the-ear hearing aids, and to one or more microphones may be added to make hearing aid 60 a directional hearing aid system. For example, as shown in FIG. 6, microphone 108 may be located at the top of on-ear speaker component 10, 109 may be located at the side of on-ear speaker component 10 and 110 may be located on the other side of on-ear speaker component 10. Microphones 108-110 each have corresponding ports 108P-110P in on-ear speaker component housing 100. Microphones 108-110 may be connected to other processing circuitry in behind-the-ear component 300 or on-ear speaker component 10, either of which processes the sound for delivery to speaker 101. The processing circuitry is adapted to create the directionality of hearing aid 60 based on input through the various microphones 3002 and 108-110. Further, in embodiments of the invention, the behind-the-ear component may include processing circuitry that can adapt from using a single microphone in the behind component to using two or more microphones when the behind-the-ear component is connected to a transducer module that includes a microphone.

In embodiments of the invention, the position of microphone(s) 108-110 within on-ear speaker housing 100 and the shape of on-ear speaker housing 100 facilitate a specific alignment to obtain directional microphone performance for hearing aid 60. Such alignment of the microphones may be made with one or more of microphones 108-110 within on-ear speaker housing 100. In embodiments, at least one of microphones 108-110 positioned in on-ear speaker component housing 100 will be aligned with a microphone 3002 in behind-the-ear component 300 or in an in canal component or other component of the auditory communication device. In embodiments of the invention, the position of the microphone in the transducer component (e.g. on-ear speaker component 10) is in a predetermined alignment with the microphone on the behind-the-ear component (e.g. behind-the-ear component 300) to create a predetermined directional pattern when the transducer component and the behind-the-ear component are electrically and communicatively coupled together. It should be noted that in some embodiments there are no microphones in on-ear speaker component 10.

Figure 7:
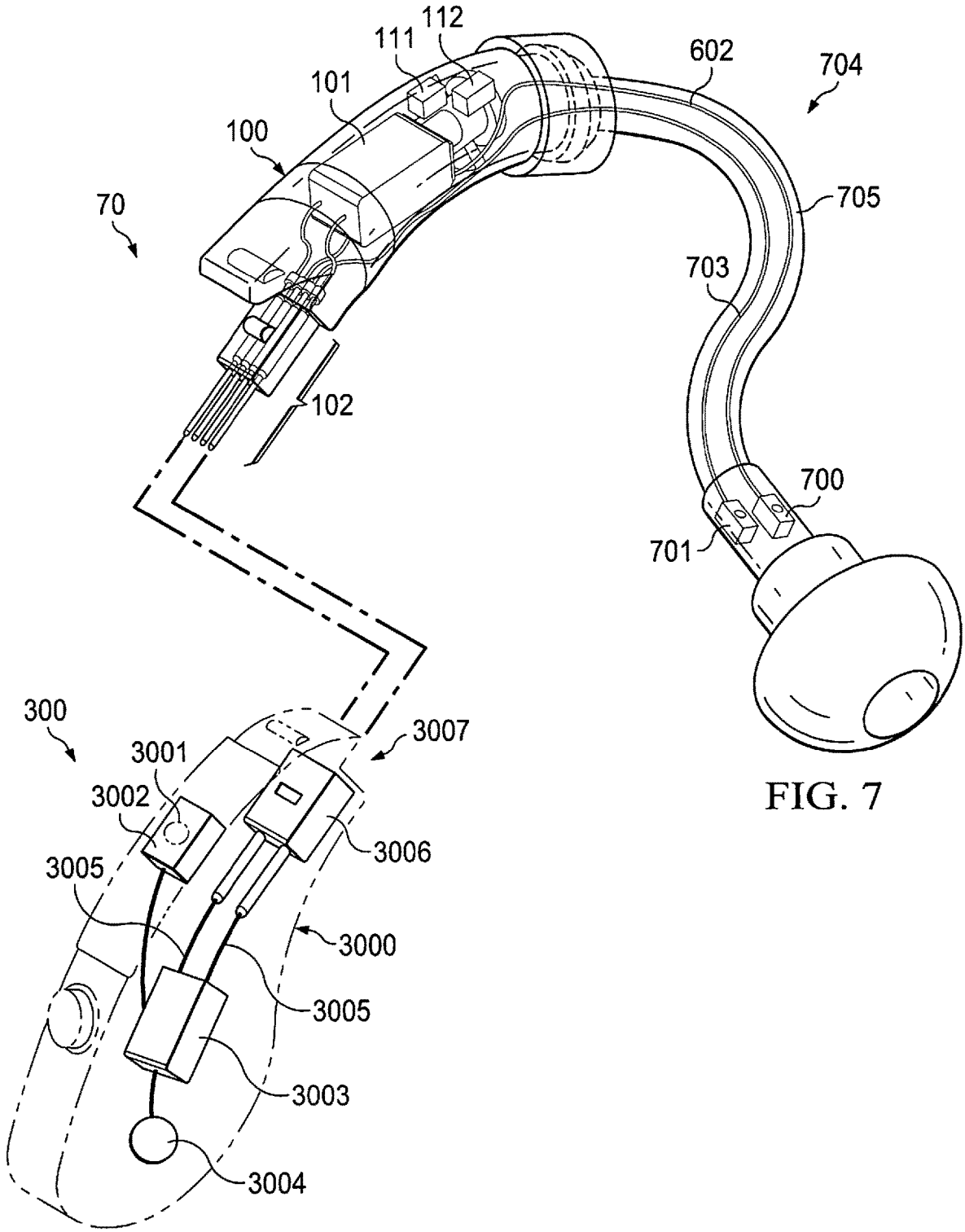
FIG. 7 shows a hearing aid according to embodiments of the invention.
Figure 8A:
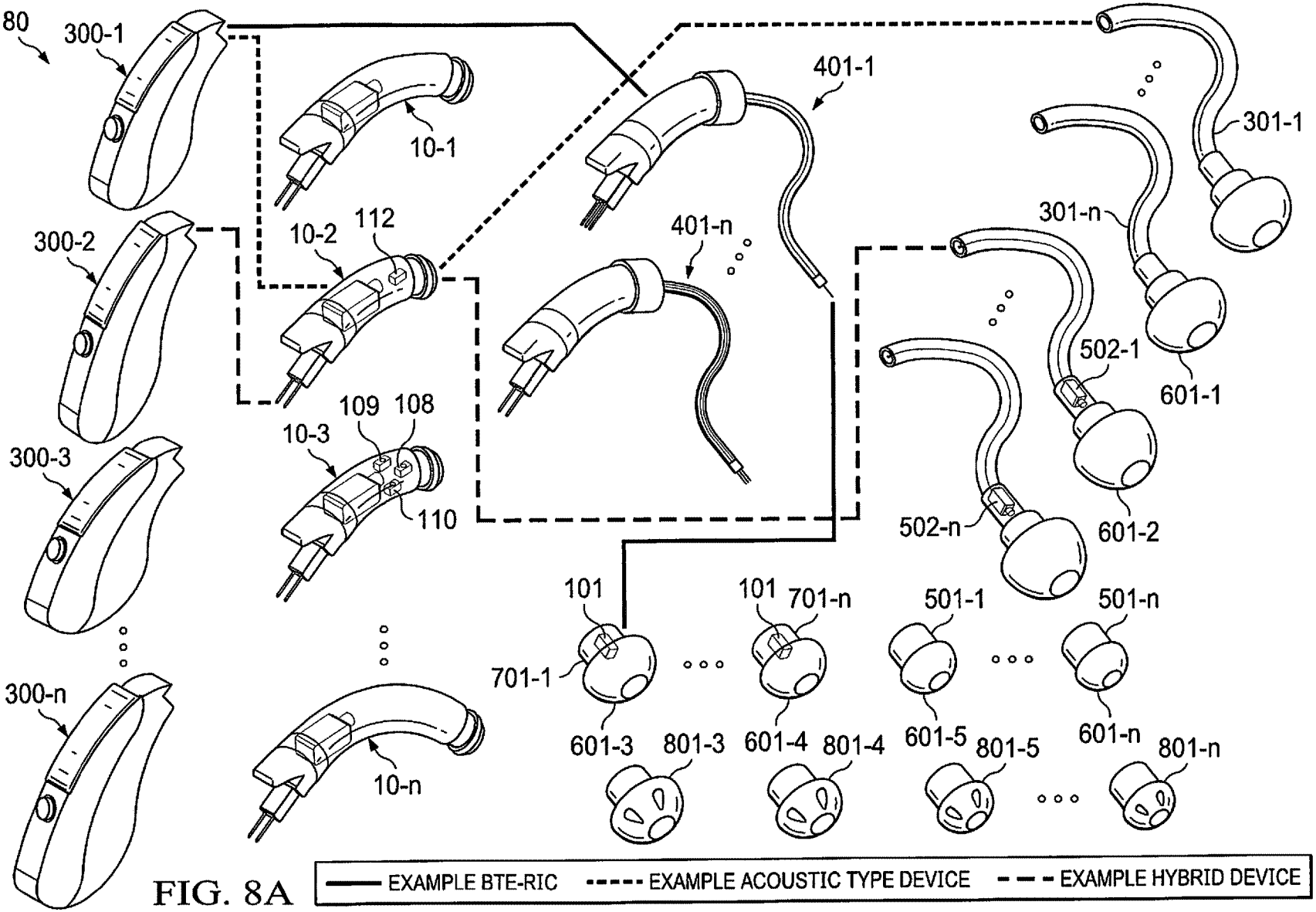
FIG. 8 shows a kit for assembling hearing aids according to embodiments of the invention.
Figure 8B:
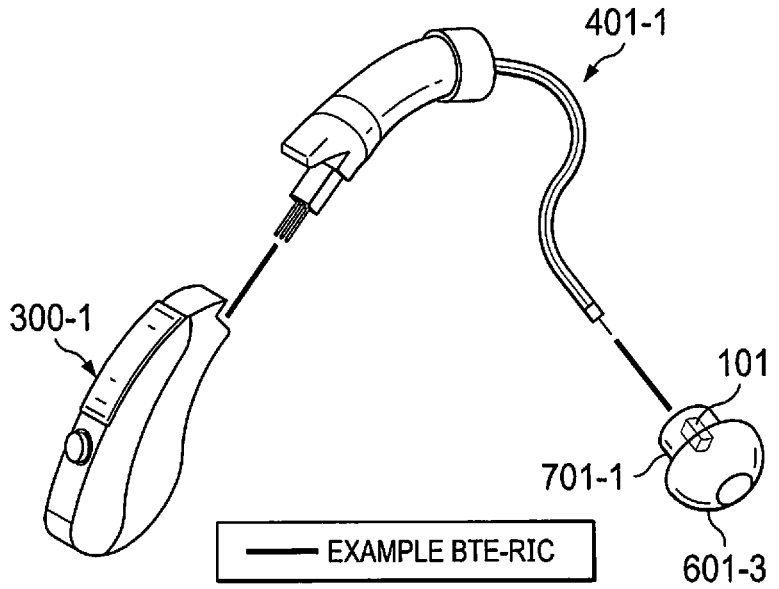
Figure 8C:
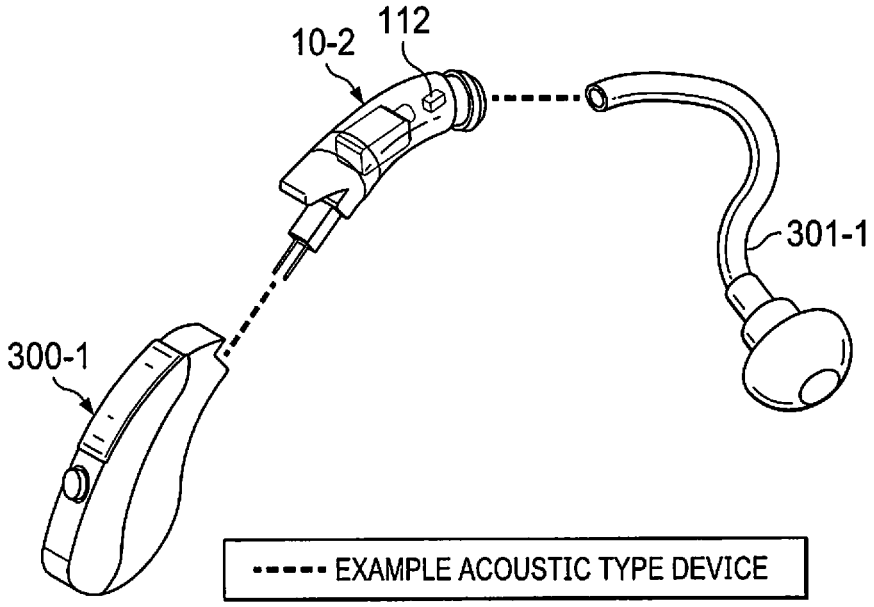
Figure 8D:
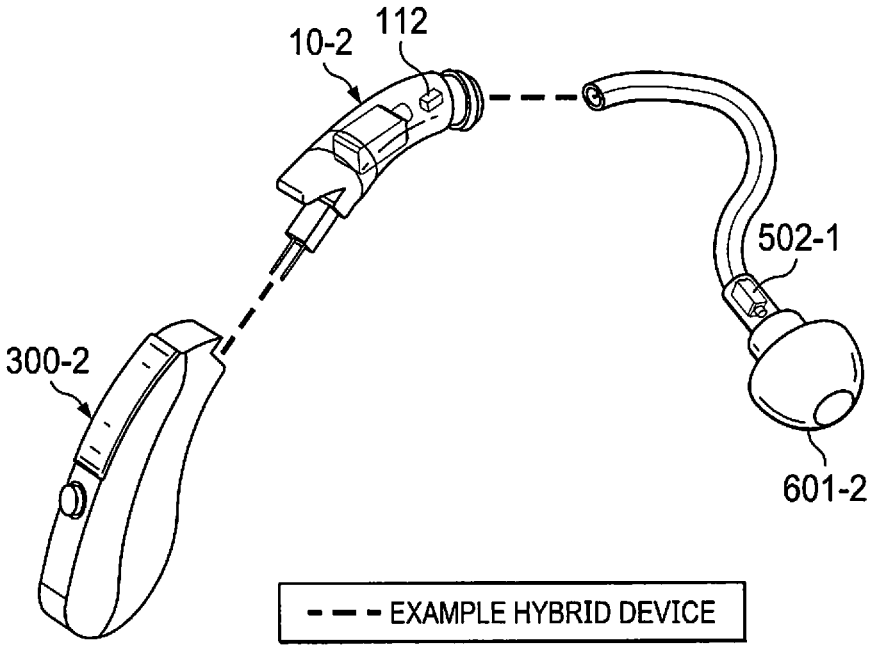

FIG. 7 shows hearing aid 70 according to embodiments of the invention. Hearing aid 70 includes microphone 700 located at the end of sound tube 705 so that it is disposed in the user's ear canal in use. Microphone 700 may be utilized for noise cancellation purposes, as a hearing aid input, and/or sound detection or measurement purposes, and/or to capture a user's voice for later transmission. This feature may be combined with one or more microphones located in behind-the-ear component 300 and on-ear speaker component 10, or both.

Additionally, hearing aid device 70 may include other monitoring devices such monitor 111 and 112 in on-ear speaker component 10 and monitor 701 located at the end of sound tube 305 so that it is disposed in the user's ear canal in use. These monitors may be adapted to measure vital information relating to, e.g., pulse, temperature, pressure, etc. The measurements may be relayed to circuitry in on-ear speaker component 10 or behind-the-ear component 300, which may process this information and communicate the information to the user, for example, via a screen of a different device that is wirelessly connected to hearing aid device 70 or by speaker 101 from hearing aid device 70. When monitors 701, 111, and 112 are included, the electrical connections of these devices may be accommodated by connector 102. Further, processing circuitry 3003 of hearing aid 70 may be configured to monitor and analyze the types of connections present in order to facilitate the functionality of the various connected devices. For example, upon receiving connections to multiple speakers, the processing circuitry understands that different equalizer settings between the speakers and dipper amplification may be preferably utilized.

As FIG. 3A shows, hearing aid 30 may include on-ear speaker component 10, behind-the-ear component 300, sound tube 301, and ear piece 302, which all may be detachably connected together to form hearing aid 30. In this way, hearing aid 30 is a modular device. However, in embodiments of the invention, hearing aid 30 may be produced so that its components are not detachable and are more permanently connected such as being glued, screwed together, and the like. When hearing aid 30 is modular, embodiments of the invention may include a kit of hearing aid components that include a plurality of different on-ear components. This kit may be offered, after manufacturing, in the market, to a dispenser, distributor, or user for selection to assemble a hearing aid. The plurality of different on-ear components may have different combination of features so that the features of the selected on-ear speaker housing is the best fit (electronically and physically) for the user. These features may include: shape of housing, size of housing, amount of speakers, speakers with different performance characteristics, other processing circuitry such as one or more microphones, and combinations thereof. It should be noted that the features of size and shape may relate more directly to the use of the on-ear speaker component as an ear hook and features such as amount of speakers, speakers with different performance characteristics, other processing circuitry such as one or more microphones may relate to the functionality of the on-ear speaker housing, including functionality with respect to the other components of the hearing aid device that is attached to the on-ear component to form the hearing aid device.

In that regard, the kit of hearing aid components for assembling a hearing aid may include other hearing aid components such as a plurality of behind-the-ear components, a plurality of sound tubes, a plurality of connectors, a plurality of ear molds, a plurality of in canal components having speakers, a plurality of completely-in-canal components having speakers, and combinations thereof. Each of these plurality of components may have different electronic or physical features, or both so that components can be selected ("mix and matched") to form the hearing aid to achieve the best fit for the user electronically and physically.

An advantage in the modularity of hearing aid 30 according to embodiments of the invention is that the kit may be used to create different types of devices. For example, an audiologist trying to fit a patient with a hearing aid may want to try various types of hearing aids. In such a fitting, according to embodiments of the invention, behind-the-ear component 300 may be connected to on-ear speaker component 10 and sound tube 301 to yield an acoustic tube-style device. Further, the audiologist is able to connect behind-the-ear component 300 with an electrical connector and in canal or completely in canal component having a speaker to yield a RIC-style device. The versatility presented by embodiments of the present invention assists with many practical concerns such as providing better inventory controls, and functional concerns such as being able to account for different degrees of hearing loss using different devices.

In sum, in embodiments of the invention, a user, distributor, or dispenser may assemble a hearing aid device to electronically and physically tailor the device to the user by selecting and combining the electronic and physical features, to tailor to a user, from the following components: on-ear components, behind-the-ear components, sound tubes, completely-in-canal components, in-canal components, electrical connectors, hybrid electrical connector/sound tubes, and combinations thereof.

For example, the plurality of behind-the-ear components may include components of different types, shapes, sizes, functional capabilities, different sound processing circuitry, microphone of different performance characteristics, and combinations thereof. The different features of the in-canal components and the completely in-canal components may include: shape of component, size of component, amount of speakers, speakers with different performance characteristics, processing circuitry of different performance characteristics such as one or more microphones, and combinations thereof. The different features of the ear pieces may include: materials, size, shape, vented, unvented and combinations thereof.

Embodiments of invention including a kit as mentioned above are discussed in more detail in relation to FIG. 8. FIG. 8 shows kit 80 according to embodiments of the invention. Kit 80 is a kit of different types of hearing aid components. Kit 80 may include a plurality of behind-the-ear components (e.g. behind-the-ear components **300-1-300-*n*). Each of behind-the-ear components 300-1-300-*n* may include a microphone and processing circuitry. Behind-the-ear components 300-1-300-*n* may include behind-the-ear components of different functionalities. Those functionalities may include different electronic functionalities such as processing circuitry with different performance characteristics, microphones of different performance characteristics, and combinations thereof. The different functionalities of behind-the-ear components 300-1-300-*n*** may include differences in any feature of behind-the-ear components described herein, e.g. the electronic functionalities, size, shape, and combinations thereof.

Kit 80 may also include a plurality of a plurality of on-ear speaker components (e.g. on-ear speaker components **10-1-10-*n*). Each of on-ear speaker components 10-1-10-*n* includes a speaker. On-ear speaker components 10-1-10-*n* are adapted to mechanically and electronically couple to any of behind-the-ear components 300-1-300-*n*. On-ear speaker components 10-1-10-*n* may include on-ear speaker components of different functionalities. Those functionalities may include different electronic functionalities such as speakers with different performance characteristics, processing circuitry with different performance characteristics, microphones with different performance characteristics, presence of monitor devices and combinations thereof. The different functionalities of on-ear speaker components 10-1-10-*n*** may include differences in any feature of on-ear speaker components described herein, e.g. the electronic functionalities, size, shape, internal volume, presence channels, presence of vents, and combinations thereof.

Kit 80 may also include a plurality of a plurality of sound tubes (e.g. sound tubes **301-1-301-1-*n*). Sound tubes 301-**

1-301-1-*n* are adapted to couple to any of on-ear speaker components 10-1-10-*n*. Sound tubes 301-1-301-1-*n* may have different functionalities. The different functionalities may include differences in features of sound tubes described herein such as sound tubes of, different shapes, different lengths, different internal diameters, and different outer diameters.

Kit 80 may also include a plurality of in-canal components and/or a plurality of completely-in-canal components (e.g. in-canal components and completely-in-canal components 701-1-701-*n*). Each of the plurality of in-canal components and plurality of completely-in-canal components includes speaker 101. In-canal components and completely-in-canal components 701-1-701-*n* may have different functionalities. Those functionalities may include electronic functionalities of the in-canal or completely-in-canal components such as different performance characteristics, processing circuitry with different performance characteristics, microphones with different performance characteristics, presence of monitor devices, and combinations thereof. The different functionalities of in-canal components and completely-in-canal components 701-1-701-*n* may include difference in any feature of in-canal components described herein such as size, shape, presence of vents, and combinations thereof.

Kit 80 may also include a plurality of electrical connectors (e.g. electrical connectors 401-1-401-*n*). Each of electrical connectors 401-1-401-*n* may be adapted to mechanically and electrically couple to any of behind-the-ear components 300-1-300-*n* and to any of in-canal components and completely-in-canal components 701-1-701-*n*. Electrical connectors 401-1-401-*n* may have different functionalities. The different functionalities may include differences in features of electrical connectors described herein such as electrical connectors of different lengths.

Kit 80 may also include a plurality of a plurality of a plurality of hybrid sound tube/in-canal or completely-in-canal speaker device. (e.g. hybrid sound tube/in-canal or completely-in-canal speaker 502-1-502-*n*). Each of hybrid sound tube/in-canal or completely-in-canal speaker 502-1-502-*n* may be adapted to mechanically and electrically couple to any of behind-the-ear components 300-1-300-*n*. Hybrid sound tube/in-canal or completely-in-canal speaker 502-1-502-*n* may have different functionalities. Those functionalities may include electronic functionalities such as speakers with different performance characteristics, processing circuitry with different performance characteristics, presence of monitor devices, and combinations thereof. The different functionalities of hybrid sound tube/in-canal or completely-in-canal speaker 502-1-502-*n* may include differences in any feature of hybrid sound tube/in-canal or completely-in-canal speaker described herein such as sound tubes or electrical connectors of, different shapes, different lengths, different internal diameters, and different outer diameters.

Kit 80 may include a plurality of ear molds (e.g. ear molds 601-1-601-*n*). Ear pieces 601-1-601-*n* may be adapted to be attached to sound tubes 301-1-301-1-*n*, in-canal components and completely-in-canal components 701-1-701-*n*, hybrid sound tube/in-canal or completely-in-canal speaker 502-1-502-*n*, and combinations thereof. Ear molds 601-1-601-*n* may have different functionalities. The different functionalities may include differences in features of ear molds described herein such as ear molds of different shapes and sizes. As illustrated in FIG. 8, the ear molds (e.g. ear molds 801-1-801-*n*) may be vented.

Kits according to embodiments of the invention may include any subset of components or types of components of kit 80. A distributor, audiologist or user can use components of kit 80 to make different types of hearing aids that are tailored physically and electronically to the user. In other words different combinations of components of kit 80 may be selected and assembled to cooperate with each other to meet the requirements of the user (e.g. the functionalities and features of each component in the selected combination cooperates to produce a hearing aid specifically tailored to the user). For example, behind-the-ear component 300-1, electrical connector 401-1, in-canal component 701-1, and ear piece 601-3 may be selected and combined to form a RIC type hearing aid device. Likewise, behind-the-ear component 300-1, on-ear component 10-2, sound tube 301-1, and ear piece 601-1 may be selected and combined to form an acoustic type device. Further, behind-the-ear component 300-2, on-ear component 10-2, hybrid sound tube/in-canal or completely-in-canal 502-1, and ear piece 601-2 may be selected and combined to form hybrid sound acoustic/RIC type hearing aid device.

Figure 9:
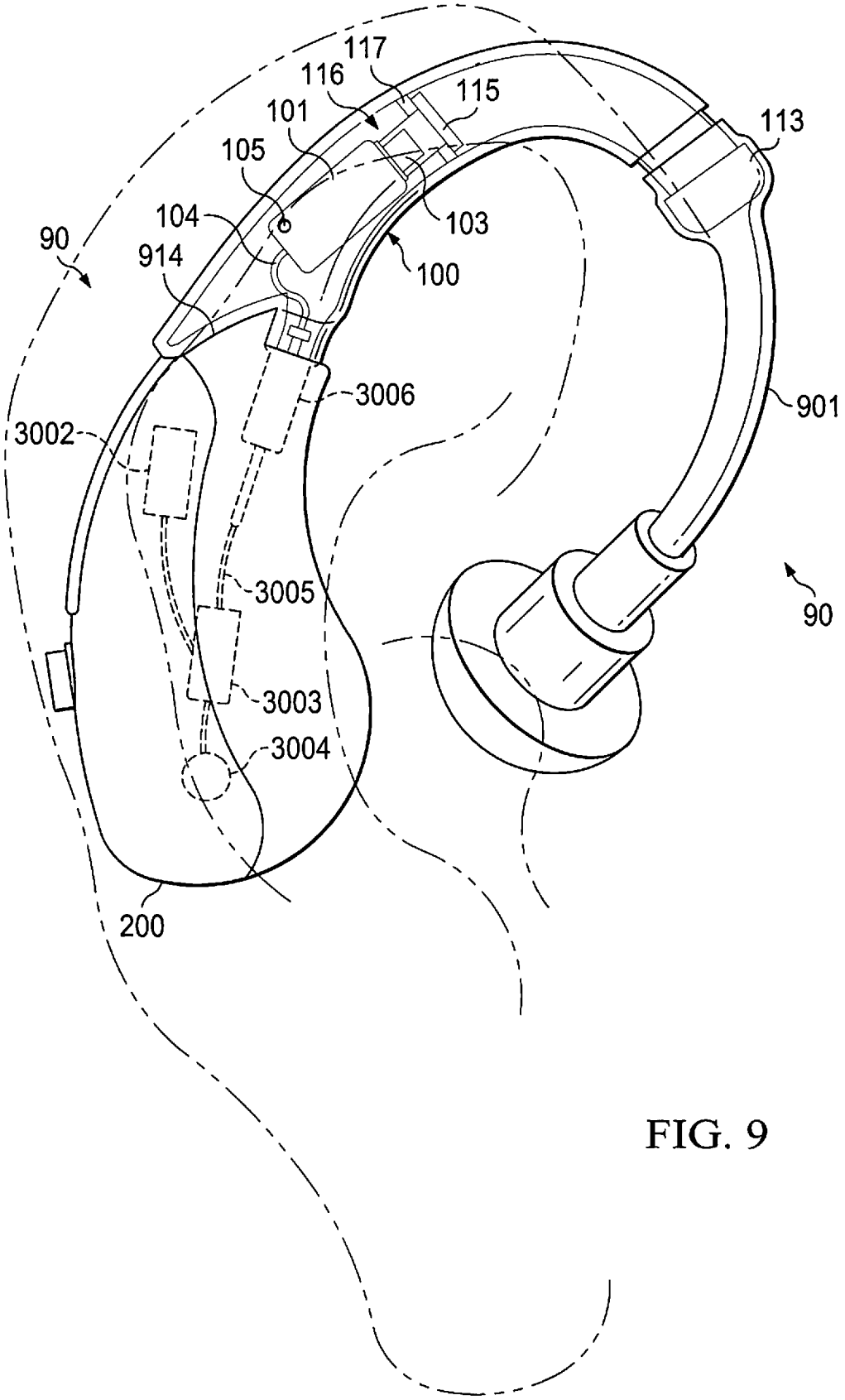
FIG. 9 shows a hearing aid according to embodiments of the invention

FIG. 9 shows hearing aid 90 according to embodiments of the invention. Hearing aid 90 has features like to hearing aid 20 except the configuration of the sound tubes, the configuration of the attachments of sound tubes to speaker 101 and speaker sound port 103, and the size of space 116 are different. As shown in FIG. 9, sound tube 115 may be attached by a friction fit to speaker sound port 103. Further, in hearing aid 90, walls 900 reduce space 116 as compared with the similar space of hearing aid 20. Sound tube 115 keeps speaker 101 at least partially suspended in space 116 such that speaker 101 does not touch inner wall 114. Suspending speaker 101 in this way is one method of providing mechanical isolation between speaker 101 and microphone 3002 and processing circuitry 3003 disposed in behind-the-ear component 300. Additionally or alternatively, in embodiments of the invention, space 116 may be filled at least partially with material (e.g. a gel, foam etc.) that provides mechanical isolation between on-ear speaker component 10 (including speaker 101) and microphone 3002 and processing circuitry 3003 disposed in behind-the-ear component 300.

In embodiments of the invention, the length of on-ear speaker component 100 may vary. For example, FIG. 2 shows hearing aid 20, which has an on-ear speaker component that is longer than the on-ear speaker component of FIGS. 3A and 3B. In embodiments such as hearing aid 30, in which the on-ear speaker component is relatively short, the sound tube that leads from the on-ear speaker component may advantageously be adapted to be relatively thin (a relatively small inner diameter, e.g. 0.031 inch inner diameter) and the ear piece to which the sound tube is attached may be an open fit, closed fit or partially vented ear piece. The relatively thin tube that may be used with embodiments such as hearing aid 30 may provide advantages such as being more cosmetically appealing, being able to clip higher frequencies, and/or being operational for applications that require lower output (power).

In embodiments such as hearing aid 20 in which the on-ear speaker component is relatively long, the sound tube that leads from the on-ear speaker component may advantageously adapted to be relatively large (a relatively large inner diameter, e.g. like the size of a typical behind-the-ear hearing device ear hook) and the ear mold to which the sound tube is attached may be an open fit, closed fit, or partially vented ear piece. For the relatively larger tubes, the on-ear speaker component may wrap around the ear, e.g. see FIG. 2. The relatively large tube that may be used with embodiments such as hearing aid 20 may provide advantages such as being operational for applications that require higher output (power) and being operational for applications that require higher frequencies. Thin or narrow tube options may also be preferred in some applications with an on ear speaker component that wraps around the ear.

Figure 10:
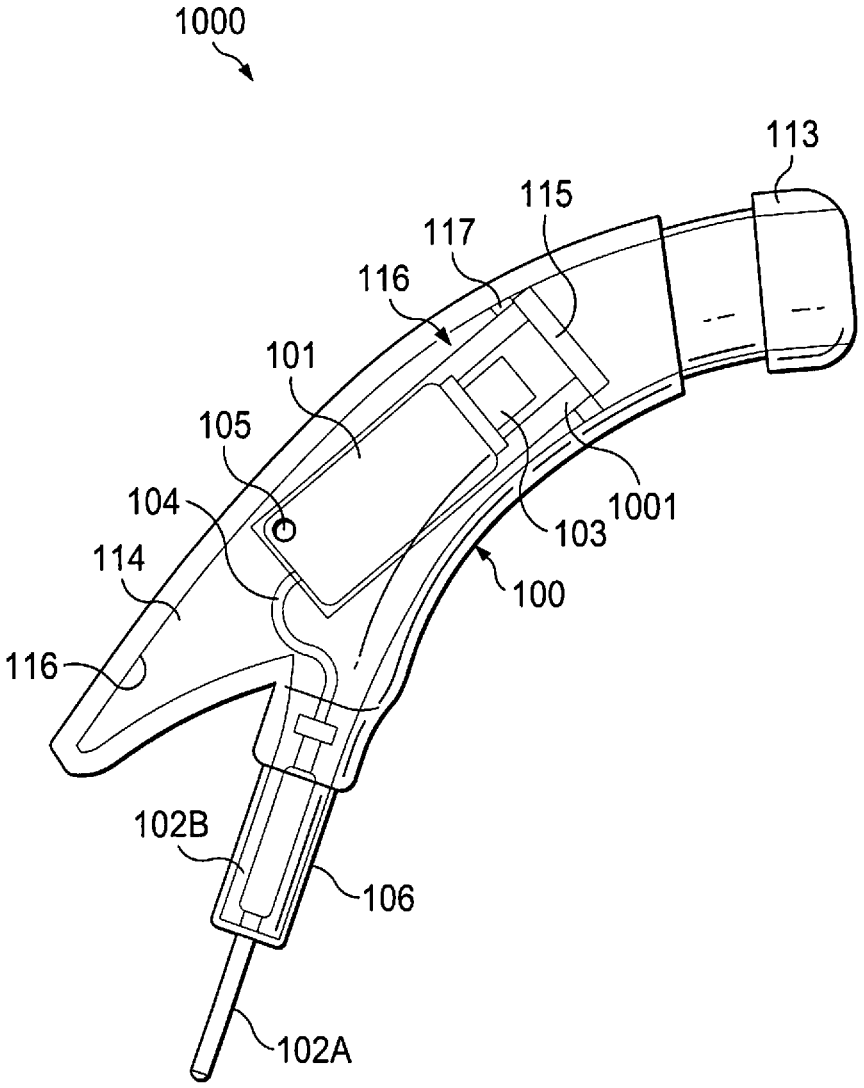
FIG. 10 shows an on-ear speaker component for an auditory communication device according to embodiments of the invention.

FIG. 10 shows on-ear speaker component 1000 according to embodiments of the invention. On-ear speaker compartment 1000 similar to on-ear speaker component 10, FIG. 1, except that on-ear speaker 101 is disposed in a second housing, housing 1001.

Figure 11:
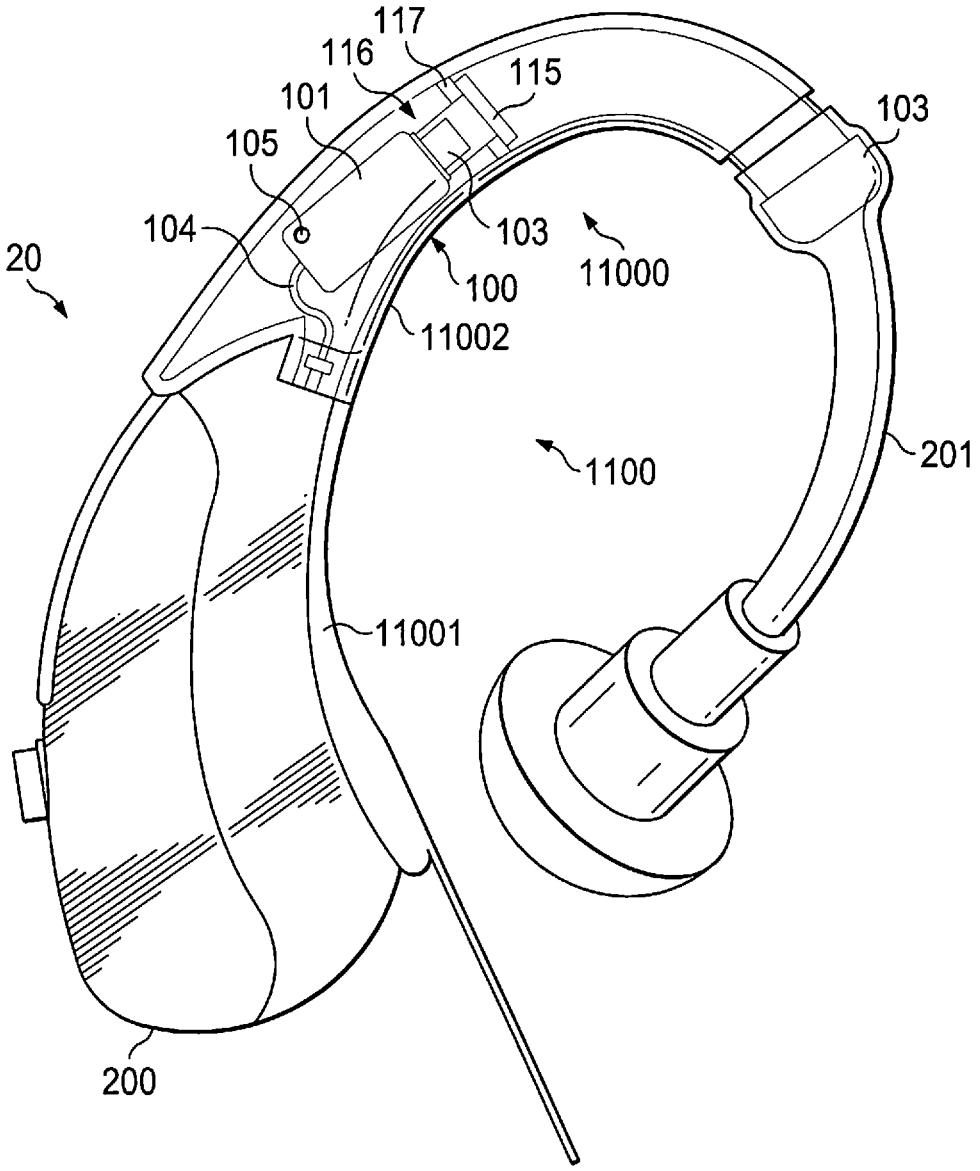
FIG. 11 shows a hearing aid according to embodiments of the invention.

FIG. 11 shows hearing aid 1100 according to embodiments of the invention. Hearing aid 1100 includes transducer component 11000 having antenna 11001 extending from housing 11002 of transducer component 11000. Transducer component 11000 is adapted to be attached to behind-the-ear component 300. In some embodiments a portion of the transducer component 11000 that is attached and or in contact with behind-the-ear (BTE) component 300 may be used enclose the battery 3004 in the BTE component. A benefit of such embodiment would allow the BTE component to be smaller and reduce cost by eliminating the need for a separate battery door on the BTE component. As described with respect to FIGS. 3A and 3B, behind-the-ear component 300 may have elements such as microphone port 3001, one or more microphones 3002, one or more communications links 3005, processing circuitry 3003 (which may include sound processing circuitry), a power source 3004, and combinations thereof. According to embodiments of the invention, an antenna feature is added to a hearing aid device by providing transducer component 11000. In embodiments, the auditory communication device may not include a behind-the-ear component and transducer component 11000 may have a wireless feature for connecting antenna 11001 to a device remote from the auditory communication device. Further, in embodiments the antenna may not be an extension of the housing but instead is disposed within the housing.

Figure 12:
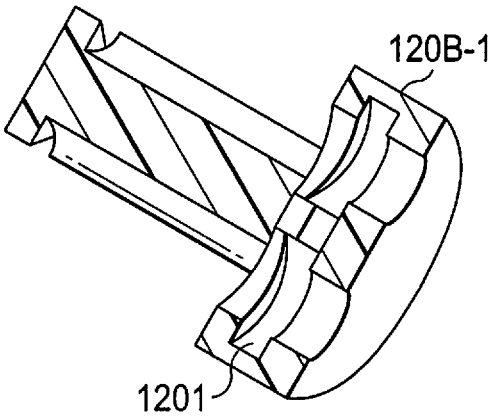
FIG. 12 shows a connector sub-assembly according to embodiments of the invention.
Figure 13:
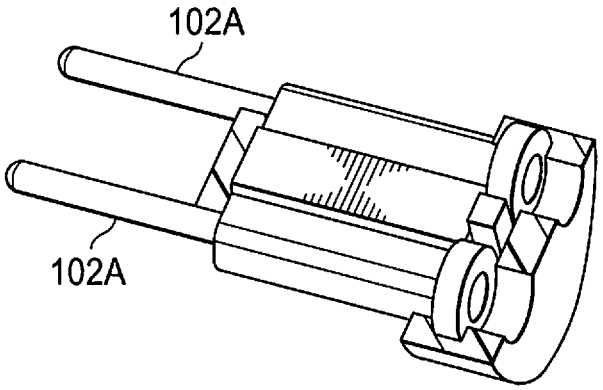
FIG. 13 shows a connector according to embodiments of the invention.
Figure 14:
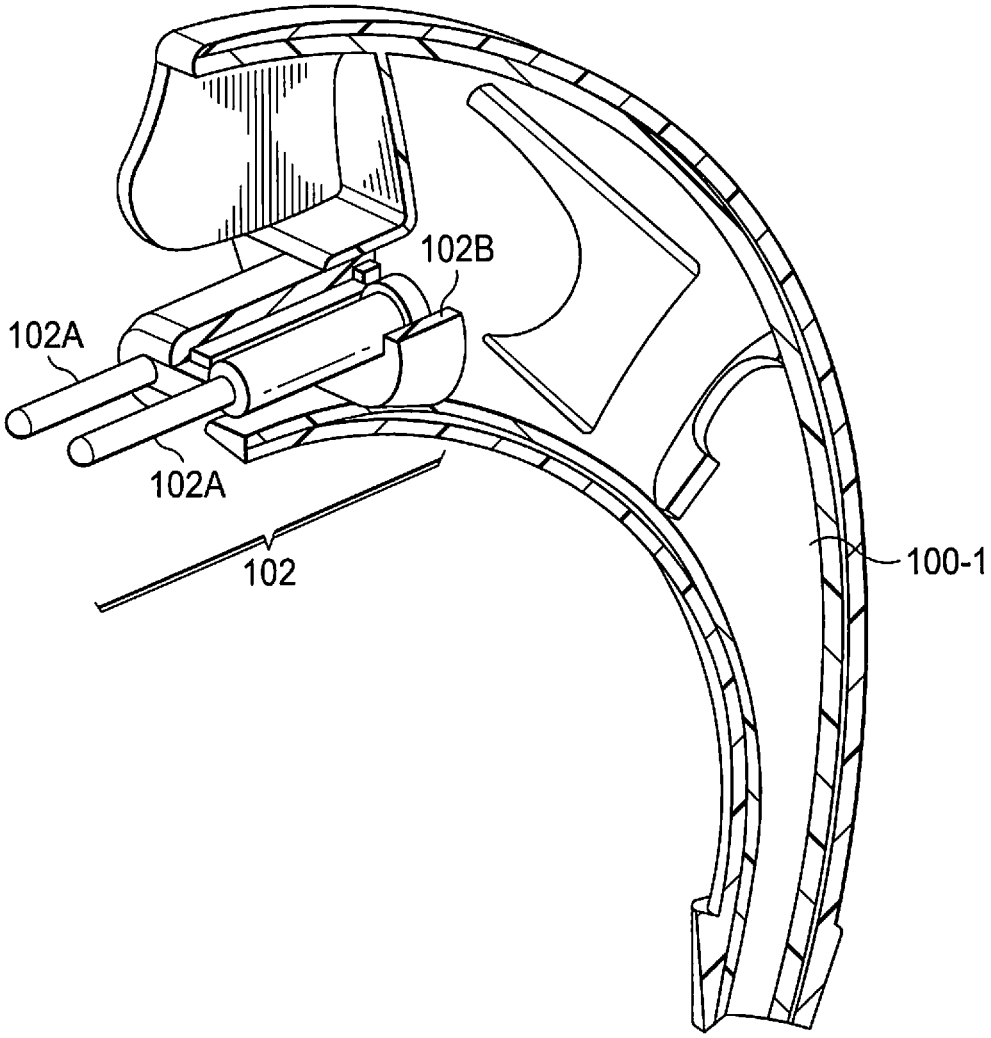
FIG. 14 shows a connector assembly inserted into an on-ear housing according to embodiments of the invention.

FIGS. 12-14 illustrates an assembly process of on-ear speaker component 10 shown in FIG. 1, according to embodiments of the invention. FIG. 12 shows details of connector 102 of one-ear component 10 according to embodiments of the invention. FIG. 12 shows connector sub assembly 102B-1. Connector sub assembly 102B-1 may be made of materials such as plastic or rubber so that electrical connectors 102A may be insulated, mechanically isolated, and protected from dirt and moisture. Connector sub assembly 102B-1 has recessed areas 1201 for receiving electrical connectors 102A. In assembling a transducer module according to embodiments of the invention, electrical connectors 102A may be placed in recessed areas 1201. FIG. 13 shows electrical connectors 102A disposed in connector sub assembly 102B-1. Then, in the assembly process, another connector sub assembly 102B-1 is installed to on top of connector sub assembly 102B-1 and electrical connectors 102A. Connector 102 (that includes 102A and 102B (two 102B-1*s*)) is then inserted into housing 10 as shown in FIG. 14. It should be noted that on-ear speaker component housing 100 may include two halves that are assembled together (one half shown in FIG. 14 as half housing 10-1) to form on-ear speaker component housing 100 (shown in FIG. 1).

In embodiments of the invention, in the assembly process, after assembling electrical connector 102 from connector sub assembly 102B-1 and electrical connectors 102A, two half housings 100-1 are clamped together to enclose the elements of on-ear speaker component 10 shown in FIG. 1, including connector 102, shown in FIG. 14. It should be noted that clamping the two half housings 100-1 around sound tube 115 during assembly provides an acoustic seal around sound tube 115 and positions speaker 101 within on-ear speaker component housing 100. A conformal coating may be applied around the sound tube, connector assembly and seams around the receiver cavity prior to closing the two halves of the housing to improve the acoustic seal. When the two half housings 100-1 are assembled and connected together in this way they create a sealed pocket (space 116 in FIG. 1). The "T" shape of sound tube 115 shown in FIG. 1 also contributes to the acoustic sealing in of space 116. This process of assembling an on-ear component according to embodiments of the invention provides efficiency in manufacturing on-ear speaker component 10 and a hearing device in which on-ear speaker component 10 may be disposed. This efficiency is provided by the fact that speaker 101, sound tube 115, electrical connector 102A and insulating portion 102B, and wire may be preassembled prior to sealing them into on-ear speaker component housing 100.

As described above, embodiments of the invention involve a transducer component that occupies the typical position of an ear hook of a conventional behind-the-ear hearing aid device. In this way, elements traditionally place in the behind-the-ear component can be removed from that component and placed in the transducer component and thereby make the behind-the-ear component smaller. At the same time, the transducer component, in the form of an ear hook is not any bigger than the typical ear hook of the conventional behind-the-ear hearing aid. In this way, the transducer components according to embodiments of the invention utilize space of the hearing aid more efficiently. In other words, conventional behind-the-ear hearing aids waste space in the ear hook.

Although the embodiments of the present disclosure and their advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An on-ear speaker component for a hearing aid device, the on-ear speaker component comprising:

an on-ear speaker housing;

a speaker disposed in the on-ear speaker housing;

an electrical connection adapted to communicatively couple the speaker to a microphone in a behind-the-ear component, the on-ear speaker component is adapted to be disposed on an ear of a user, behind the pinna of the ear; and a connector adapted to detachably connect the on-ear speaker component to the behind-the-ear component.

2. The on-ear speaker component of claim 1 further comprising:

a first sound tube connected to the speaker, the first sound tube leads into an acoustic channel formed by the on-ear speaker housing, the acoustic channel ends at a sound port adapted to connect to a second tube adapted to conduct sound from the acoustic channel to an ear canal of the user.

3. The on-ear speaker component of claim 1 wherein the electrical connection comprises a multi-pronged plug adapted to electrically and physically mate with a corresponding multi-hole socket of the behind-the-ear component.

4. The on-ear speaker component of claim 3 wherein the on-ear speaker housing is adapted to physically mate with and connect to the behind-the-ear component.

5. The on-ear speaker component of claim 1, wherein the internal volume of the on-ear speaker housing is adapted so that it cooperates with the speaker to provide a pre-determined frequency response.

6. A hearing aid device comprising:

a behind-the-ear component that includes a microphone disposed in a behind-the-ear component housing; the behind-the-ear component is adapted to be disposed behind an ear of a user in operation of the hearing aid device;

an on-ear speaker component that includes a speaker disposed in an on-ear speaker component housing; the on-ear speaker component is adapted to be disposed on the ear of the user, behind the pinna of the ear, in operation of the hearing aid device; and an electrical connection between the microphone and the speaker when the on-ear speaker component and the behind-the-ear component are coupled together, wherein the behind-the-ear component housing and the on-ear speaker component housing are different housings and the behind-the-ear component housing and the on-ear speaker component housing are adapted to be detachably connected to each other.

7. The hearing aid device of claim 6 further comprising:

a sound tube communicatively connected to the on-ear speaker component housing to conduct sound from the speaker to an ear canal of the user.

8. The hearing aid device of claim 6 wherein the electrical connection between the microphone and the speaker comprises a multi-pronged plug of the on-ear speaker component that electrically and physically mates with a corresponding multi-hole socket of the behind-the-ear component.

9. The hearing aid device of claim 6 wherein the behind-the-ear component housing and the on-ear speaker component housing are adapted to physically mate with and connect to each other.

10. The hearing aid device of claim 6 further comprising:

a latching mechanism between the behind-the-ear component housing and the on-ear speaker component housing.

11. The hearing aid device of claim 6, wherein the on-ear speaker component comprises a microphone and the position of the microphone in the on-ear speaker component is in alignment with the microphone of the behind-the-ear component to create a predetermined directional pattern.

12. The hearing aid device of claim 6, wherein the internal volume of the on-ear speaker component housing is adapted so that it cooperates with the speaker to provide a predetermined frequency response.

13. The hearing aid device of claim 6 further comprising:

another speaker disposed outside of the on-ear speaker component housing.

14. The hearing aid device of claim 13 wherein the other speaker is disposed in the ear canal of the user in operation of the hearing aid device.

15. An on-ear transducer component for a hearing aid device, the on-ear transducer component comprising:

a transducer housing;

an antenna disposed in or being a part of the transducer housing; and an electrical connection communicatively coupling the antenna to processing circuitry in a behind-the-ear component, the on-ear transducer component is adapted to be disposed on an ear of a user, behind the pinna of the ear; and a connector adapted to detachably connect the on-ear transducer component to the behind-the-ear component.

16. The on-ear transducer component of claim 15 further comprising:

a speaker; and a first sound tube connected to the speaker, the first sound tube leads into an acoustic channel formed by the transducer housing, the acoustic channel ends at a sound port adapted to connect to a second tube adapted to conduct sound from the acoustic channel to an ear canal of the user.

17. The on-ear transducer component of claim 15 wherein the electrical connection comprises a multi-pronged plug adapted to electrically and physically mate with a corresponding multi-hole socket of the behind-the-ear component.

18. The on-ear transducer component of claim 17 wherein the transducer housing is adapted to physically mate with and connect to the behind-the-ear component.

19. An on-ear speaker component for an auditory communication device, the on-ear speaker component comprising:

a speaker housing shaped to fit around an ear of a user so that when in use a first portion of the speaker housing is positioned behind the ear, a second portion of the speaker housing on top of the ear and a third portion of the speaker housing in front of the user's ear;

a speaker disposed in the speaker housing;

an electrical connection adapted to communicatively couple the speaker to a microphone and/or signal processing circuitry in a housing different from the speaker housing; and a first sound tube connected to the speaker, the first sound tube leads into an acoustic channel formed by the speaker housing, the acoustic channel ends at a sound port of the speaker housing, the sound port adapted to be communicatively connected to a second sound tube to conduct sound from the on-ear speaker component to the ear canal of the user, wherein the second sound tube is selected from a plurality of sound tubes of different lengths to meet requirements of the user.

20. The on-ear speaker component of claim 19 wherein the electrical connection comprises a multi-pronged plug adapted to electrically and physically mate with a corresponding multi-hole socket of a behind-the-ear component.

21. The on-ear speaker component of claim 20 wherein the speaker housing is adapted to physically mate with and connect to a housing of the behind-the-ear component.

22. An on-ear speaker component for an auditory communication device, the on-ear speaker component comprising:

a speaker housing shaped to fit around an ear of a user so that when in use a first portion of the speaker housing is positioned behind the ear, a second portion of the speaker housing on top of the ear and a third portion of the speaker housing in front of the user's ear;

a speaker disposed in the speaker housing; and an electrical connection adapted to communicatively couple the speaker to a microphone and/or signal processing circuitry in a housing different from the speaker housing, wherein the speaker is positioned in a sealed inner cavity such that the internal volume of the sealed inner cavity is adapted so that it cooperates with the speaker to provide a pre-determined frequency response.

23. The on-ear speaker component of claim 22, wherein the speaker includes a vented portion that is positioned in a manner to use the internal volume of the sealed inner cavity to increase low frequency output of the on-ear speaker component.

24. An on-ear speaker component for an auditory communication device, the on-ear speaker component comprising:

a speaker housing shaped to fit around an ear of a user so that when in use a first portion of the speaker housing is positioned behind the ear, a second portion of the speaker housing on top of the ear and a third portion of the speaker housing in front of the user's ear;

a speaker disposed in the speaker housing; and an electrical connection adapted to communicatively couple the speaker to a microphone and/or signal processing circuitry in a housing different from the speaker housing, wherein the speaker housing includes an inner cavity adapted so that the speaker fits within the inner cavity, wherein a sound port extending from the speaker to which a sound tube is attached and the sound tube interfaces with the speaker housing such that moisture, skin oils, dirt or air flow around the sound port is restricted, wherein the sound port extending from the speaker is adapted in a manner to facilitate suspending the speaker within the inner cavity.

25. The on-ear speaker component of claim 24, wherein the sound tube is held in place by extensions from the speaker housing.

26. The on-ear speaker component of claim 25, wherein the on-ear speaker component is adapted to reduce mechanical feedback from the speaker housing to the microphone and/or the signal processing circuitry.

27. A communication device comprising:

a behind-the-ear component that includes a microphone disposed in a behind-the-ear component housing; the behind-the-ear component is adapted to be disposed behind an ear of a user in operation of the communication device;

a transducer module component that includes a speaker disposed in a transducer module component housing; the transducer module component is adapted to be disposed on the ear of the user, behind the pinna of the ear, in operation of the communication device; and an electrical connection between the microphone and the speaker, when the transducer module component and the behind-the-ear component are coupled together, wherein the behind-the-ear component housing and the transducer module component housing are different housings and the behind-the-ear component housing and the transducer module component housing are adapted to be detachably connected to each other.

28. The communication device of claim 27, wherein the transducer module component includes a microphone.

29. The communication device of claim 28, wherein the position of the microphone on the transducer module component is in a predetermined alignment with the microphone on the behind-the-ear component to create a predetermined directional pattern when the transducer module component and the behind-the-ear component are electrically and communicatively coupled together.

30. The communication device of claim 27, wherein the behind-the-ear component comprises processing circuitry that is configured to adapt from using a single microphone in the behind-the-ear component to using two or more microphones when the behind-the-ear component is connected to a transducer module that includes a microphone.

31. A communication device comprising:

a behind-the-ear component that includes a processing circuitry disposed in a behind-the-ear component housing; the behind-the-ear component is adapted to be disposed behind an ear of a user in operation of the communication device;

a transducer module component that includes an antenna disposed in the transducer module component housing; the transducer module component is adapted to be disposed on and/or around the ear of the user in operation of the communication device; and an electrical connection between the behind-the-ear component and the transducer module component, when the transducer module component and the behind-the-ear component are coupled together, wherein the behind-the-ear component housing and the transducer module component housing are different housings.

32. The communication device of claim 31 further comprising:

a speaker disposed in the transducer module component.

33. The communication device of claim 32 further comprising:

a sound tube communicatively connected to the transducer module component to conduct sound from the transducer module component to an ear canal of the user.

34. The communication device of claim 27 further comprising:

a second speaker disposed outside of the transducer module component.

35. The communication device of claim 34 wherein the second speaker is adapted to be disposed in the user's ear canal.

36. The communication device of claim 34 wherein the second speaker is electrically connected to the transducer module component.

37. The communication device of claim 34 wherein the second speaker has a higher frequency range response than the speaker in the transducer module component.

38. The communication device of claim 34 wherein the second speaker is adapted to connect wirelessly to processing circuitry.

* * * * *